US007612738B2

(12) United States Patent
Yang et al.

(10) Patent No.: US 7,612,738 B2
(45) Date of Patent: Nov. 3, 2009

(54) PLASMA DISPLAY DEVICE, APPARATUS FOR DRIVING THE SAME, AND METHOD OF DRIVING THE SAME

(75) Inventors: Hak-Cheol Yang, Yongin-si (KR); Joon-Yeon Kim, Yongin-si (KR); Jong-Ki Choi, Yongin-si (KR); Hyun-Gu Heo, Yongin-si (KR); Yong-Jin Jeong, Yongin-si (KR); Suk-Chin Sakong, Seoul (KR); Sung-Soo Hong, Seoul (KR); Chung-Wook Roh, Seoul (KR); Sang-Kyoo Han, Seoul (KR); Won-Seok Nam, Seoul (KR); Yon-Goo Park, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 323 days.

(21) Appl. No.: 11/692,877

(22) Filed: Mar. 28, 2007

(65) Prior Publication Data

US 2008/0088531 A1 Apr. 17, 2008

(30) Foreign Application Priority Data

Oct. 13, 2006 (KR) ..... 10-2006-0099937

(51) Int. Cl.
*G09G 3/28* (2006.01)

(52) U.S. Cl. ..... 345/60

(58) Field of Classification Search ..... 345/60, 345/63, 78, 204

See application file for complete search history.

(56) References Cited

U.S. PATENT DOCUMENTS 6,011,355 A * 1/2000 Nagai ..... 315/169.3

(Continued)

FOREIGN PATENT DOCUMENTS

KR 10-2003-0035003 5/2003

(Continued)

OTHER PUBLICATIONS

Korean Patent Abstracts, Publication No. 10-2003-0035003, dated May 9, 2003, in the name of Jun Yeong Lee.

(Continued)

*Primary Examiner*—Richard Hjerpe
*Assistant Examiner*—Leonid Shapiro
(74) *Attorney, Agent, or Firm*—Christie, Parker & Hale, LLP

(57) ABSTRACT

A plasma display device includes first to fourth transistors and a plurality of first electrodes. A first terminal of a first capacitor is connected to a power supply supplying a voltage. A second terminal of a second capacitor connected to a second terminal of the first capacitor is connected to a ground terminal. A first diode is connected to the first electrodes through a first inductor and a fifth transistor, which forms a voltage rising path. A second diode is connected to the first electrodes through a second inductor and a sixth transistor, which forms a voltage falling path. A third diode is connected to the third transistor and the second diode, which forms a voltage sustaining path during a voltage rising period. A fourth diode is connected to the second transistor and the first diode, which forms a voltage sustaining path of a voltage falling period.

16 Claims, 24 Drawing Sheets

U.S. PATENT DOCUMENTS 7,379,033 B2 * 5/2008 Lee et al. ..... 345/60

FOREIGN PATENT DOCUMENTS

KR 10-2004-0040908 5/2004
KR 10-2005-0015496 2/2005
KR 10-2007-0000930 1/2007

OTHER PUBLICATIONS

Korean Patent Abstracts, Publication No. 10-2004-0040908, dated May 13, 2004, in the name of Hye Jeong Kim et al.
Korean Patent Abstracts, Publication No. 10-2005-0015496, dated Feb. 21, 2005, in the name of Sang Hoon Lee et al.
Korean Patent Abstracts, Publication No. 10-2007-0000930, dated Jan. 1, 2007, in the name of Seong Hak Moon et al.

* cited by examiner

PLASMA DISPLAY DEVICE, APPARATUS FOR DRIVING THE SAME, AND METHOD OF DRIVING THE SAME

CROSS-REFERENCE TO RELATED APPLICATION

This application claims priority to and the benefit of Korean Patent Application No. 10-2006-0099937 filed in the Korean Intellectual Property Office on Oct. 13, 2006, the entire content of which is incorporated herein by reference.

BACKGROUND OF THE INVENTION

1. Field of the Invention

The present invention relates to a plasma display device, an apparatus for driving the same, and a method of driving the same. More particularly, the present invention relates to an energy recovery circuit of a plasma display device.

2. Description of the Related Art

A plasma display device is a display that uses plasma generated by gas discharge to display characters or images. Generally, the plasma display device is driven by dividing one frame into a plurality of subfields. During an address period of each subfield, cells are selected to be turned on or not to be turned on. During a sustain period, sustain discharge is performed on the cells to be turned on ("on-cells") so as to display images.

Particularly, since a high level voltage and a low level voltage are alternately applied to electrodes used to perform sustain discharge during a sustain period, transistors that apply a high level voltage and a low level voltage need to have a voltage corresponding to the difference between the high level voltage and the low level voltage as an internal voltage. As such, since the transistors need to have a high internal voltage, a manufacturing cost of a sustain discharge circuit increases.

The above information disclosed in this Background section is only for enhancement of understanding of the background of the invention and therefore it may contain information that does not form the prior art that is already known in this country to a person of ordinary skill in the art.

SUMMARY OF THE INVENTION

In exemplary embodiments according to the present invention, a plasma display device, an apparatus for driving the same, and a method of driving the same, are provided. A transistor having a lower internal voltage can be used in a sustain charge circuit in exemplary embodiments according to the present invention.

In an exemplary embodiment according to the present invention, a plasma display device is provided. The plasma display device includes a plurality of first electrodes; a first transistor having a first terminal electrically connected to a first power supply for supplying a first voltage; a second transistor having a first terminal electrically connected to a second terminal of the first transistor and a second terminal electrically connected to the plurality of first electrodes; a third transistor having a first terminal electrically connected to the plurality of first electrodes; a fourth transistor having a first terminal electrically connected to a second terminal of the third transistor and a second terminal electrically connected to a second power supply for supplying a second voltage; a first capacitor configured to be charged with a third voltage, the first capacitor having a first terminal connected to the first power supply; a second capacitor configured to be charged with a fourth voltage, the second capacitor having a first terminal connected to a second terminal of the first capacitor and a second terminal electrically connected to the second power supply; a first inductor electrically connected between the plurality of first electrodes and a node corresponding to a contact point between the first capacitor and the second capacitor, the first inductor for forming a charge path adapted to increase a voltage of the plurality of first electrodes; a charge voltage sustaining path electrically connected between the second terminal of the third transistor and the node, the charge voltage sustaining path being adapted to sustain the voltage of the plurality of first electrodes at a fifth voltage; a second inductor electrically connected between the plurality of first electrodes and the node, the second inductor for forming a discharge path adapted to decrease the voltage of the plurality of first electrodes; and a discharge voltage sustaining path electrically connected between the node and the first terminal of the second transistor, the discharge voltage sustaining path being adapted to sustain the voltage of the plurality of first electrodes at a sixth voltage. The plasma display device may further include a controller adapted to turn on the third and fifth transistors during a first period, to turn on the second, third, and fifth transistors during a second period, to turn on the second and fifth transistors during a third period, to turn on the first and second transistors during a fourth period, to turn on the second and sixth transistors during a fifth period, to turn on the second, third, and sixth transistors during a sixth period, to turn on the third and sixth transistors during a seventh period, and to turn on the third and fourth transistors during an eighth period.

In another embodiment of the present invention, a method of driving a plasma display device including first and second electrodes, is provided. The method includes: applying energy stored in a first capacitor charged with a first voltage, to the first electrode through a first inductor electrically connected to the first electrode, such that a voltage of the first electrode increases to a second voltage; sustaining the voltage of the first electrode through a first path from the first electrode to the first capacitor, when the voltage of the first electrode rises to the second voltage; applying the energy stored in the first capacitor to the first electrode through the first inductor, such that the voltage of the first electrode increases to a third voltage larger than the second voltage; applying a fourth voltage to the first electrode through a first power supply supplying the fourth voltage; recovering the energy stored in the first electrode by the first capacitor through a second inductor, such that the voltage of the first electrode decreases to a fifth voltage; sustaining the voltage of the first electrode through a second path from the first capacitor to the first electrode, when the voltage of the first electrode decreases to the fifth voltage; recovering the energy stored in the first electrode by the first capacitor through the second inductor, such that the voltage of the first electrode decreases to a sixth voltage smaller than the fifth voltage; and applying a seventh voltage to the first electrode through a second power supply supplying the seventh voltage.

In yet another exemplary embodiment according to the present invention, an apparatus for driving a plasma display device including first electrodes and second electrodes, is provided. The apparatus includes: a plurality of first transistors electrically connected between a first power supply for supplying a first voltage and the first electrodes; a plurality of second transistors electrically connected between a second power supply for supplying a second voltage and the first electrodes; a first capacitor adapted to be charged with a third voltage, the first capacitor having a first terminal connected to the first power supply; a second capacitor adapted to be charged with a fourth voltage, the second capacitor having a first terminal connected to a second terminal of the first capacitor and a second terminal electrically connected to the second power supply; a first resonance path adapted to increase a voltage of the first electrode using resonance between a first inductor electrically connected between the first electrodes and a node corresponding to a contact point between the first capacitor and the second capacitor, and a panel capacitor formed at the first electrodes; a first voltage sustaining path comprising a switch adapted to electrically connect a first contact point of contact points among the plurality of second transistors, and the node; a second resonance path adapted to decrease the voltage of the first electrodes using resonance between the panel capacitor formed at the first electrodes, and a second inductor electrically connected between the first electrodes and the node; and a second voltage sustaining path comprising a switch adapted to electrically connect a second contact point of contact points among the plurality of first transistors and the node.

In one embodiment, the apparatus for driving a plasma display device may be configured such that: in a state where a third transistor is turned on and the fourth voltage is applied to the second terminal of the second capacitor, the voltage of the first electrode is increased through the first resonance path; in a state where the fourth voltage is applied to the second terminal of the second capacitor, the fourth voltage is applied through the first voltage sustaining path; in a state where the fourth voltage is applied to the second terminal of the second capacitor, the third transistor is turned off, the second transistor is turned on, and the voltage of the first electrode is increased through the first resonance path; in a state where the fourth voltage is applied to the second capacitor, the first transistor is turned on, and the first voltage is applied to the first electrodes; in a state where the fourth voltage is applied to the second terminal of the second capacitor, the first transistor is turned off, the sixth transistor is turned on, and the voltage of the first electrode is decreased through the second resonance path; in a state where the fourth voltage is applied to the second terminal of the second capacitor, the second transistor is turned off, the third transistor is turned on, and the fourth voltage is applied through the second voltage sustaining path; in a state where the fourth voltage is applied to the second terminal of the second capacitor, the voltage of the first electrode is decreased through the second resonance path; and in a state where the fourth voltage is applied to the second terminal of the second capacitor, a fourth transistor is turned on, and the second voltage is applied to the first electrode.

DETAILED DESCRIPTION OF THE EMBODIMENTS

Figure 1:
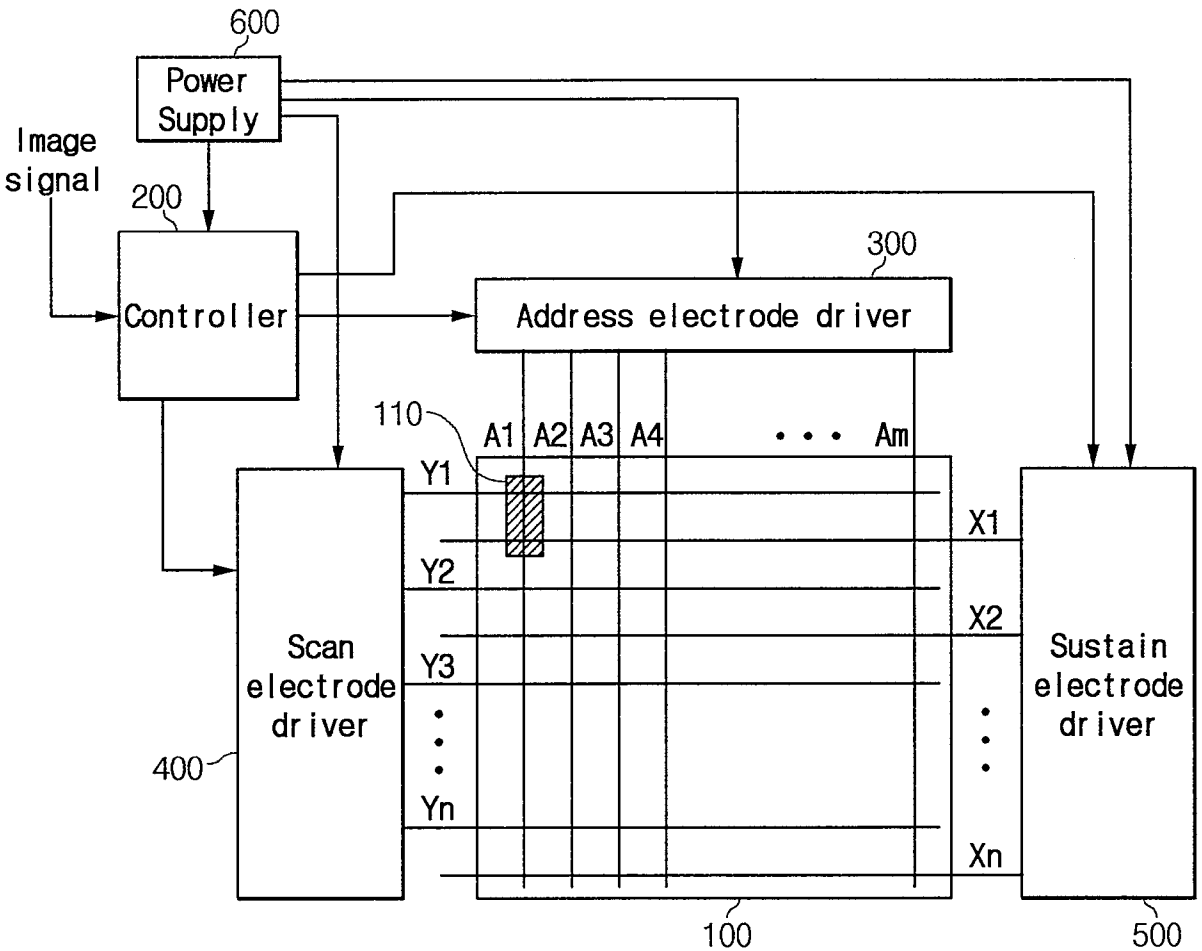
FIG. 1 is a schematic block diagram of a plasma display device according to an exemplary embodiment of the present invention.

In the following detailed description, certain exemplary embodiments of the present invention have been shown and described, simply by way of illustration. As those skilled in the art would realize, the described embodiments may be modified in various different ways, all without departing from the spirit or scope of the present invention. The present invention will now be described more fully with reference to the accompanying drawings, in which embodiments of the invention are shown, and like reference numerals designate like elements throughout the specification.

It will be understood that when an element or layer is referred to as being "connected to" or "coupled to" another element or layer, it can be directly connected or coupled to the other element or layer or intervening elements or layers may be present. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Through the specification, sustaining a voltage includes cases where even though the potential difference between specific two points varies with the time passage, the variation is in a range that is allowed in design or the variation is generated due to a parasitic component that can be ignored in a design practice of a person having ordinary skill in the art. Further, since a threshold voltage of a semiconductor element (a transistor, a diode, and the like) is much smaller than a discharge voltage, the threshold voltage is regarded as 0 V, and corresponding voltages will be discussed herein in terms of approximate numbers.

A plasma display device, a driving apparatus thereof, and a method of driving the same according to exemplary embodiments of the present invention will be described in detail with reference to the accompanying drawings.

Figure 2:
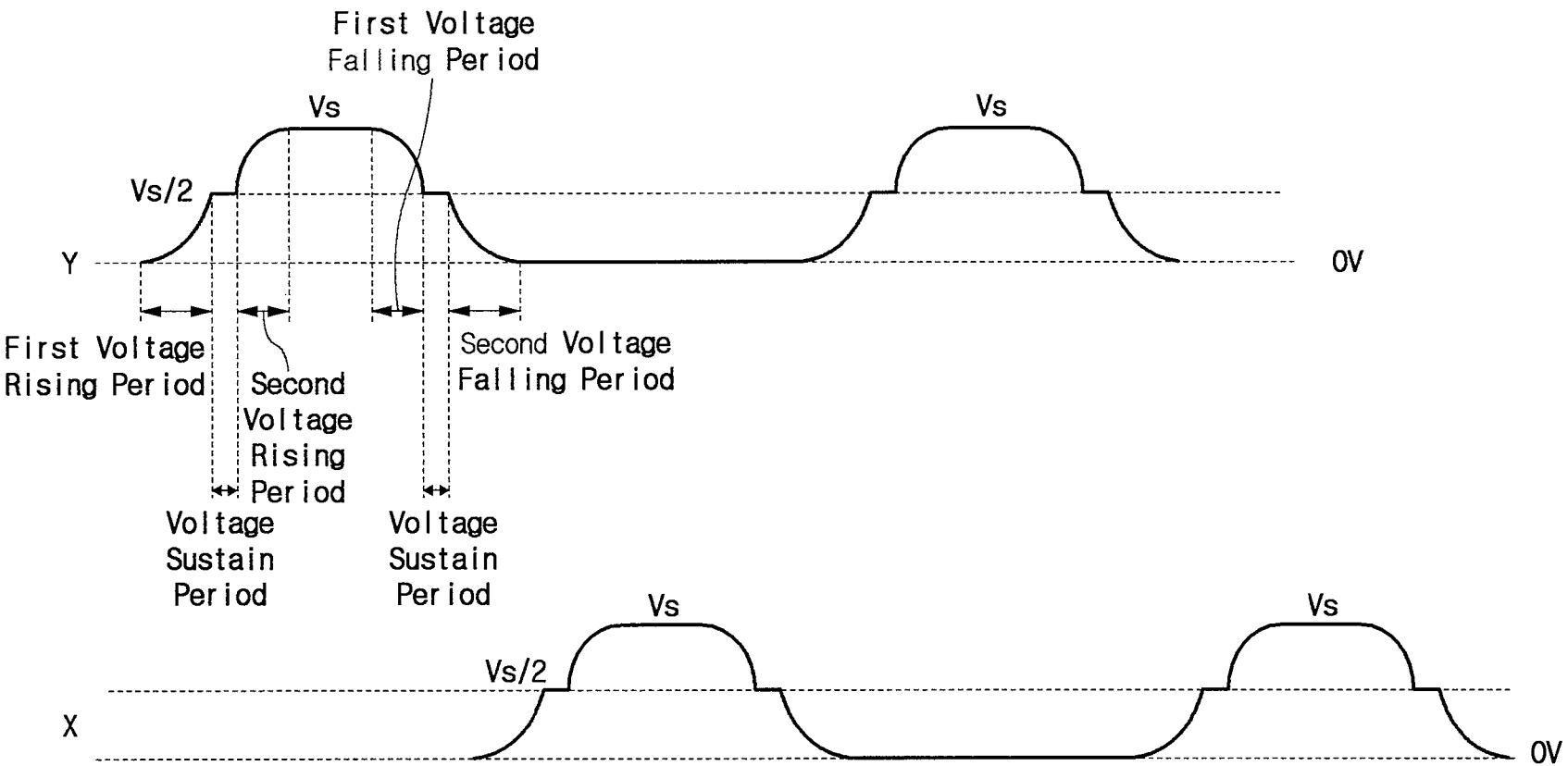
FIG. 2 is a view illustrating a sustain pulse according to an exemplary embodiment of the present invention.

FIG. 1 is a schematic conceptual view illustrating a plasma display device according to an exemplary embodiment of the present invention, and FIG. 2 is a view illustrating a sustain pulse according to a first exemplary embodiment of the present invention.

As shown in FIG. 1, a plasma display device according to an exemplary embodiment of the present invention includes a plasma display panel 100, a controller 200, an address electrode driver 300, a sustain electrode driver 500 and a scan electrode driver 400.

The plasma display panel 100 includes a plurality of address electrodes A1 to Am (hereinafter, referred to as "A electrodes") that extend in a column direction, and a plurality of sustain electrodes X1 to Xn (hereinafter, referred to as "X electrodes") and scan electrodes Y1 to Yn (hereinafter, referred to as "Y electrodes") that extend in a row direction while forming pairs with the X electrodes. Generally, the X electrodes X1 to Xn are formed to correspond to the Y electrodes Y1 to Yn, and Y electrodes Y1 to Yn and the X electrodes X1 to Xn are disposed to cross the A electrodes A1 to Am. At this time, discharge spaces that are in the crossing regions between the A electrodes A1 to Am and the X and Y electrodes X1 to Xn and Y1 to Yn form discharge cells 110.

The controller 200 receives an image signal from the outside and outputs a driving control signal. In addition, the controller 200 divides one frame into a plurality of subfields, each having a luminance weight value, and drives them. Further, each subfield includes an address period and a sustain period. According to driving control signals from the controller 200, the address electrode driver 300, the sustain electrode driver 500, and the scan electrode driver 400 apply driving voltages to the A electrodes A1 to Am, the X electrodes X1 to Xn, and the Y electrodes Y1 to Yn, respectively.

Specifically, during an address period of each subfield, the address electrode driver 300, the sustain electrode driver 500, and the scan electrode driver 400 select turn-on discharge cells ("on-cells") and turn-off discharge cells ("off-cells") in the corresponding subfield among the plurality of discharge cells 110. During a sustain period of each subfield, as shown in FIG. 2, the sustain electrode driver 500 applies sustain pulses alternately having a high level voltage Vs and a low level voltage 0 V to the plurality of X electrodes X1 to Xn by the number of times according to a weight value of the corresponding subfield. In addition, the scan electrode driver 400 applies sustain pulses to the plurality of Y electrodes Y1 to Yn in a phase opposite to that of the sustain pulses applied to the X electrodes X1 to Xn. In this case, the voltage difference between the Y electrode and the X electrode alternately has a voltage Vs and a voltage −Vs. Therefore, in a turn-on discharge cell, sustain discharge is repeatedly generated by the number of times corresponding to the weight value of the corresponding subfield.

As shown in FIG. 2, the sustain pulse according to the first exemplary embodiment of the present invention has a period during which a voltage is maintained for a time period (e.g., predetermined time) at a middle level voltage Vs/2, in a case where a voltage rises from a low level voltage 0 V to a high level voltage Vs and the voltage falls from the high level voltage Vs to the low level voltage 0 V. That is, a voltage rising period of a sustain pulse includes a first voltage rising period (0 V->Vs/2), a voltage sustain period Vs/2, and a second voltage rising period (Vs/2->Vs). Further, a voltage falling period includes a first voltage falling period (Vs->Vs/2), a voltage sustain period Vs/2, and a second voltage falling period (Vs/2->0 V).

Next, a sustain charge circuit that supplies the sustain pulses of FIG. 2 will be described in detail with reference to FIGS. 3, 4, and 5A to 5H.

Figure 3:
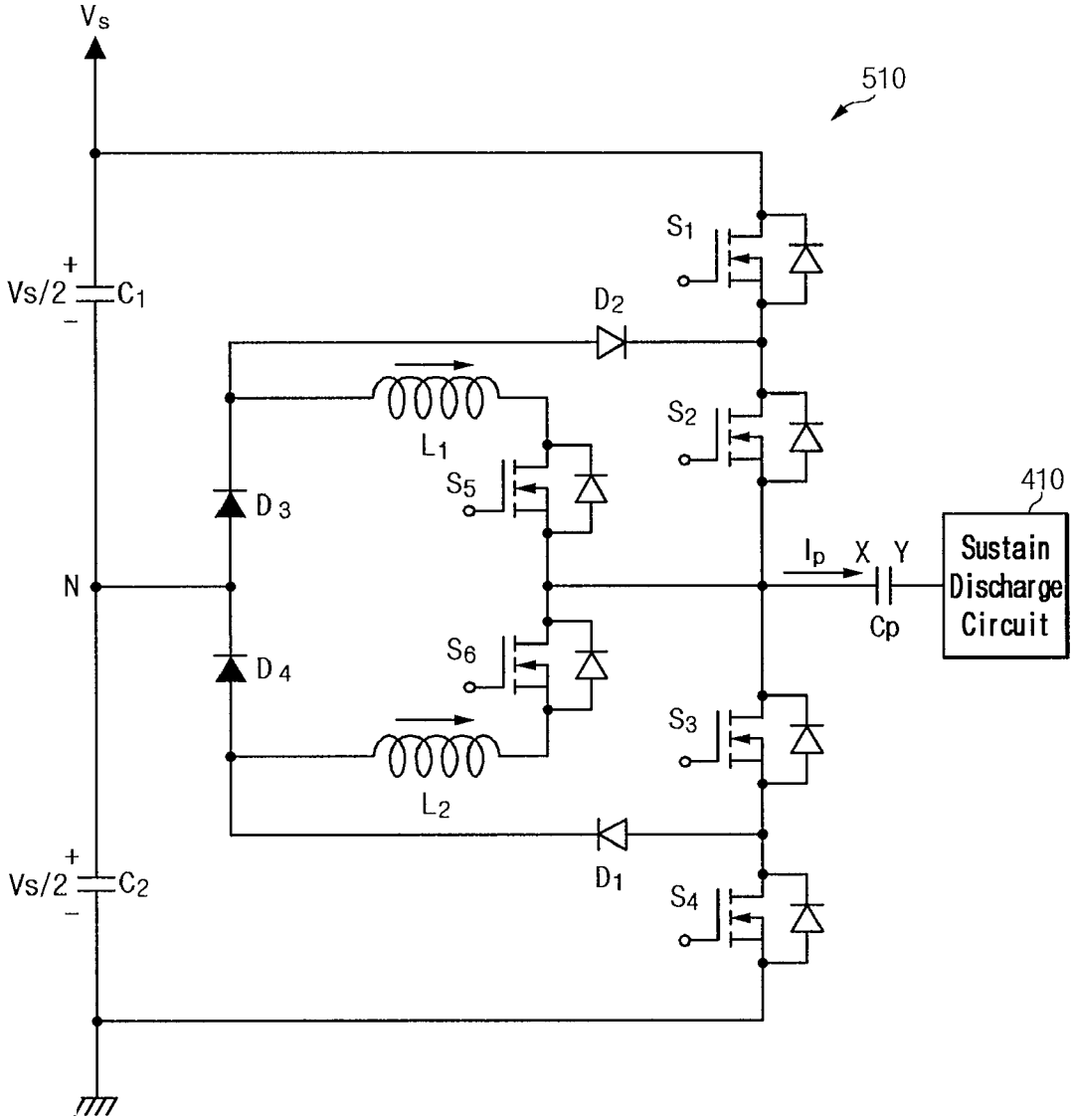
FIG. 3 is a schematic circuit diagram of a sustain discharge circuit according to a first exemplary embodiment of the present invention.

FIG. 3 is a schematic circuit diagram illustrating a sustain discharge circuit 510 according to the first exemplary embodiment of the present invention. FIG. 3 shows the sustain discharge circuit 510 connected to a plurality of X electrodes X1 to Xn for the sake of better understanding and ease of description, and the sustain discharge circuit 510 may be included in the sustain electrode driver 500 of FIG. 1. In addition, a sustain discharge circuit 410 that is connected to the plurality of Y electrodes Y1 to Yn may have the same or substantially the same structure as the sustain discharge circuit 510 of FIG. 3, or may have a structure different from that of the sustain discharge circuit 510 of FIG. 3.

The sustain discharge circuit 510 may be connected in common to the plurality of X electrodes X1 to Xn, or may be connected to some of the electrodes of the plurality of X electrodes X1 to Xn. In FIG. 3, the sustain discharge circuit 510 is illustrated as being connected to one X electrode X and the sustain discharge circuit 410 is illustrated as being connected to one Y electrode Y for the sake of better understanding and ease of description. A capacitive component that is formed by the X electrode X and the Y electrode Y is shown as a panel capacitor Cp.

As shown in FIG. 3, the sustain discharge circuit 510 according to the first exemplary embodiment includes transistors S1, S2, S3, S4, S5, and S6, inductors L1 and L2, diodes D1, D2, D3, and D4, and capacitors C1 and C2. In FIG. 3, each of the transistors S1, S2, S3, S4, S5, and S6 is shown as an n-channel field effect transistor, particularly, an NMOS (n-channel metal oxide semiconductor) transistor. In each of the transistors S1, S2, S3, S4, S5, and S6, a body diode is formed in a direction toward a drain from a source. In other embodiments, instead of the NMOS transistors, other transistors having a function similar to that of the NMOS transistor may be used as the transistors S1, S2, S3, S4, S5, and S6. In FIG. 3, each of transistors S1, S2, S3, S4, S5, and S6 is composed of one transistor, but each of the transistors S1, S2, S3, S4, S5, and S6 may include a plurality of transistors that are connected in parallel to one another in other embodiments.

Referring to FIG. 3, a drain of the transistor S1 is connected to a power supply that supplies a high level voltage Vs of a sustain pulse. The high level voltage Vs may be supplied by a capacitor that is connected to an output terminal of a switching mode power supply (SMPS), which is not shown. A source of the transistor S1 is connected to a drain of the transistor S2, and a source of the transistor S2 is connected to the X electrode. A drain of the transistor S3 is connected to the X electrode, and a source thereof is connected to a drain of the transistor S4. The source of the transistor S4 is connected to a ground terminal that supplies a low level voltage of a sustain pulse, that is, a ground voltage 0 V. A first terminal of the capacitor C1 that charges a voltage Vs/2 corresponding to a middle value (or an average value) between the high level voltage Vs of a sustain pulse and the low level voltage 0 V is connected to the power supply that supplies the high level voltage Vs of a sustain pulse, and a second terminal thereof is connected at a node N to a first terminal of the capacitor C2 that charges a Vs/2 voltage corresponding to a middle value between the high level voltage Vs of a sustain pulse and the low level voltage 0 V. A second terminal of the capacitor C2 is connected to the ground terminal that supplies the low level voltage of a sustain pulse, that is, the ground voltage 0 V. Capacitances of the capacitors C1 and C2 are selected to charge the capacitors C1 and C2 with a voltage Vs/2.

A cathode of the diode D3 whose anode is connected at the node N to a contact point between the two capacitors C1 and C2, is connected to a first terminal of an inductor L1, and a second terminal of the inductor L1 is connected to a drain of the transistor S5. An anode of a diode D4 whose cathode is connected to the contact point between the two capacitors C1 and C2, is connected to a first terminal of an inductor L2, and a second terminal of the inductor L2 is connected to a source of the transistor S6. Further, the diode D1 has an anode that is connected to a source of the transistor S3 and a cathode that is connected to the anode of the diode D4, and the diode D2 has a cathode that is connected to the drain of the transistor S2 and an anode that is connected to the cathode of the diode D3.

Next, the operation of the sustain discharge circuit 510 shown in FIG. 3 will be described in detail with reference to FIG. 4, and FIGS. 5A to 5H.

Figure 4:
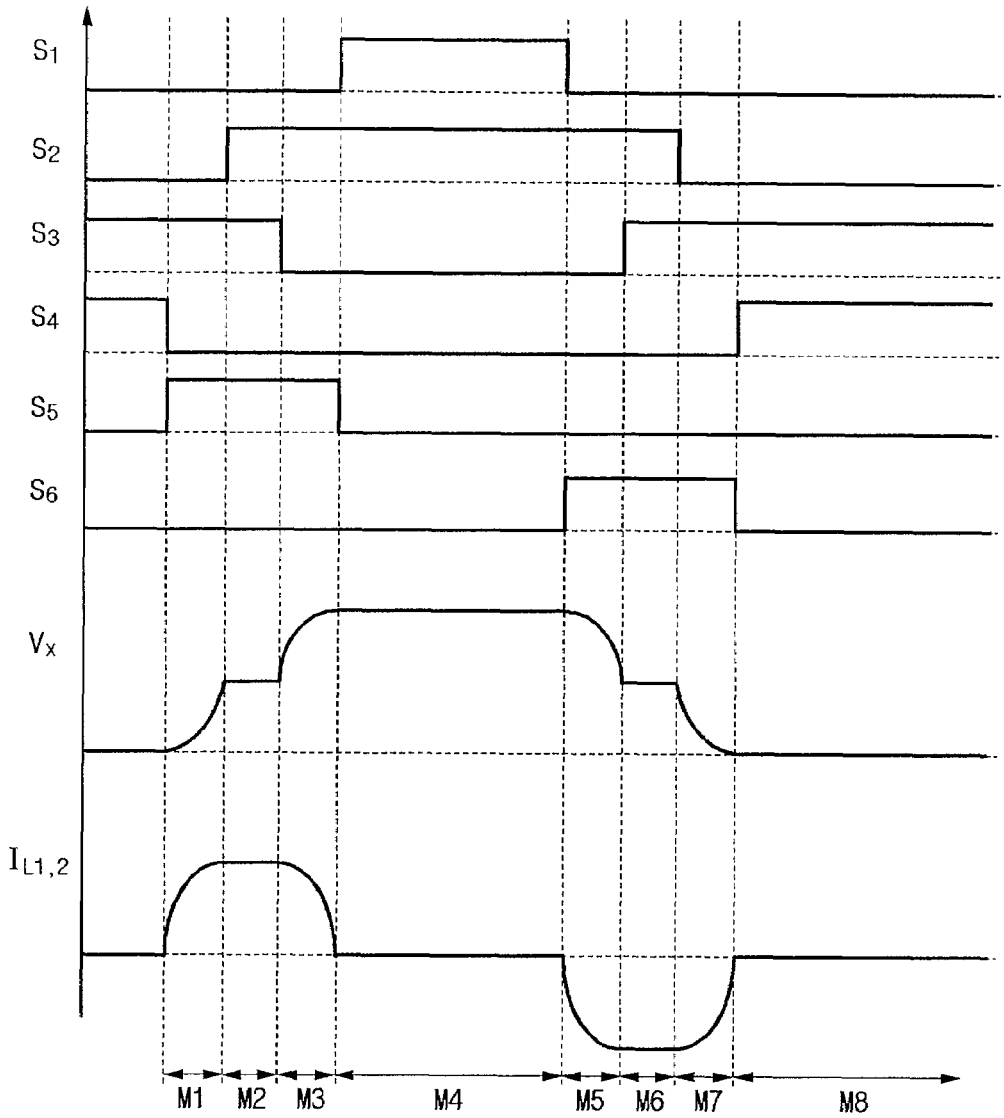
FIG. 4 is a signal timing diagram of a sustain discharge circuit according to a first exemplary embodiment of the present invention.

FIG. 4 is a signal timing diagram illustrating signals of the sustain discharge circuit 510 according to the first exemplary embodiment of the present invention, and FIGS. 5A to 5H are views illustrating the operation of the sustain discharge circuit 510 according to the signal timing of FIG. 4.

First, right before a first mode M1 of FIG. 4 (e.g., during a previous mode M8), it is assumed that the transistors S3 and S4 are turned on, and a voltage Vx of the X electrode is maintained at a voltage of 0 V.

Figure 5A:
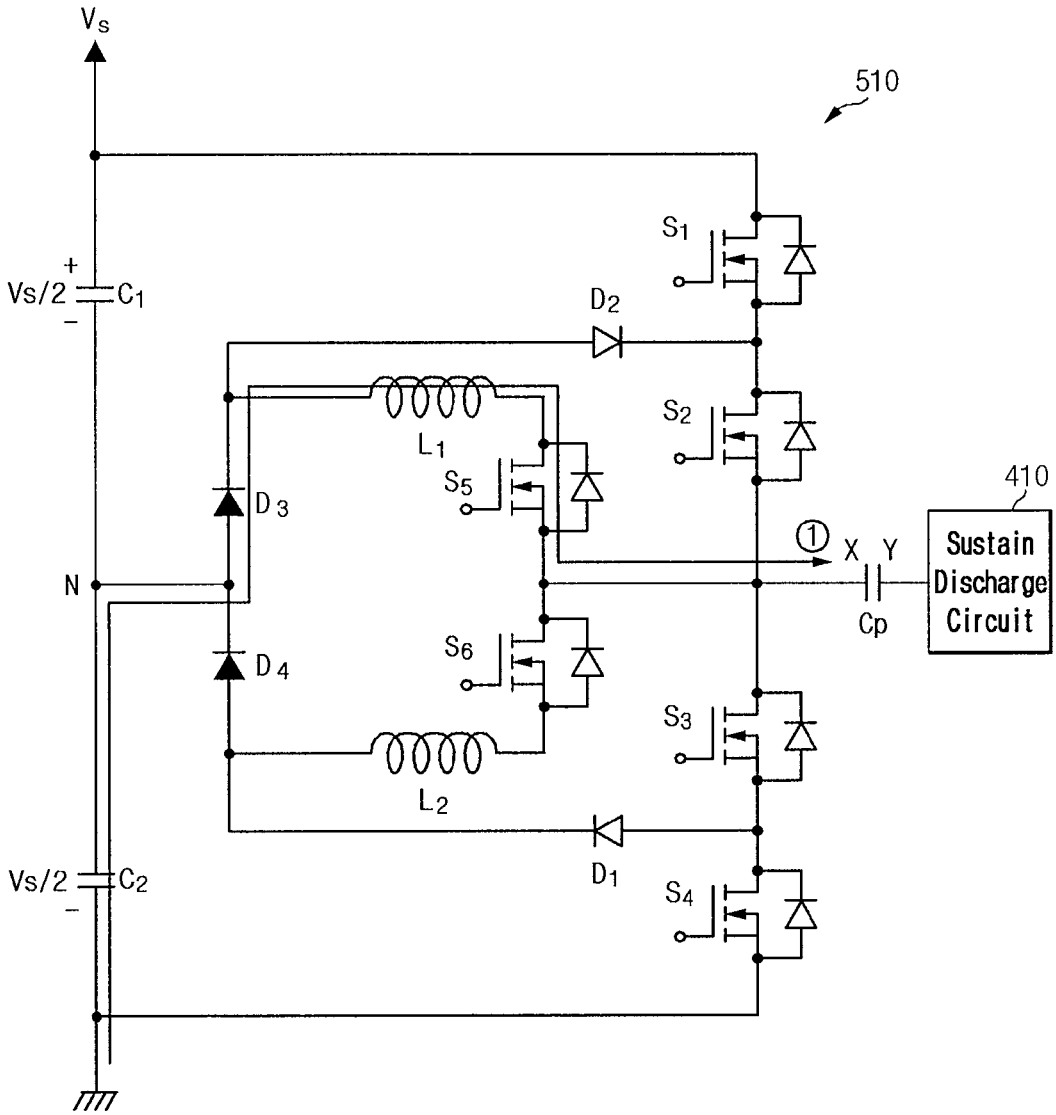
FIGS. 5A to FIG. 5H are views illustrating the operation of a sustain discharge circuit of FIG. 3 according to a signal timing of FIG. 4.

Referring to FIGS. 4 and 5A, in the first mode M1, in a state in which the transistor S3 is turned on, the transistor S4 is turned off, and the transistor S5 is turned on. Then, as shown in FIG. 5A, an inductor L1 forms a resonance path ① through the capacitor C2, the diode D3, the inductor L1, the transistor S5, and the capacitor Cp. As a result, the energy charged in the capacitor C2 is applied to the X electrode through the inductor L1, which generates a first voltage rising period during which the voltage Vx of the X electrode rises from the 0 V voltage to the voltage Vs/2.

Figure 5B:
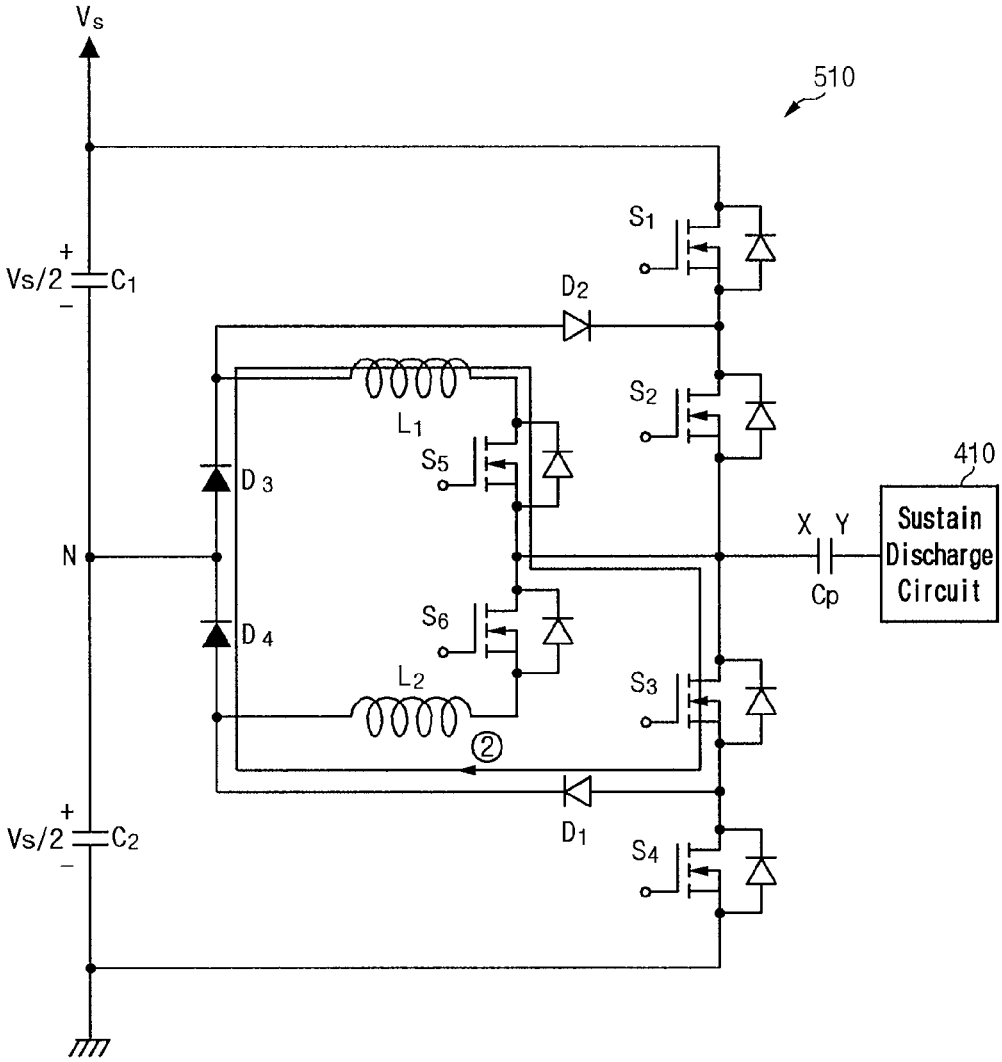

In a second mode M2, the transistors S3 and S5 maintain turned-on states, and the transistor S2 is turned on. As shown in FIG. 5B, if the voltage at the X electrode rises and becomes equal to the voltage Vs/2 charged in the capacitor C2, the transistor S3 of a turned-on state, and the diode D1 whose anode is connected to the source of the transistor S3 and whose cathode is connected to the anode of the diode D4, form a current path ② of the transistor S3, the diode D1, the diode D4, the diode D3, the inductor L1, and the transistor S5, and the voltage of Vs/2 is maintained. As a result, during the voltage rising period, a voltage sustain period is formed.

Figure 5C:
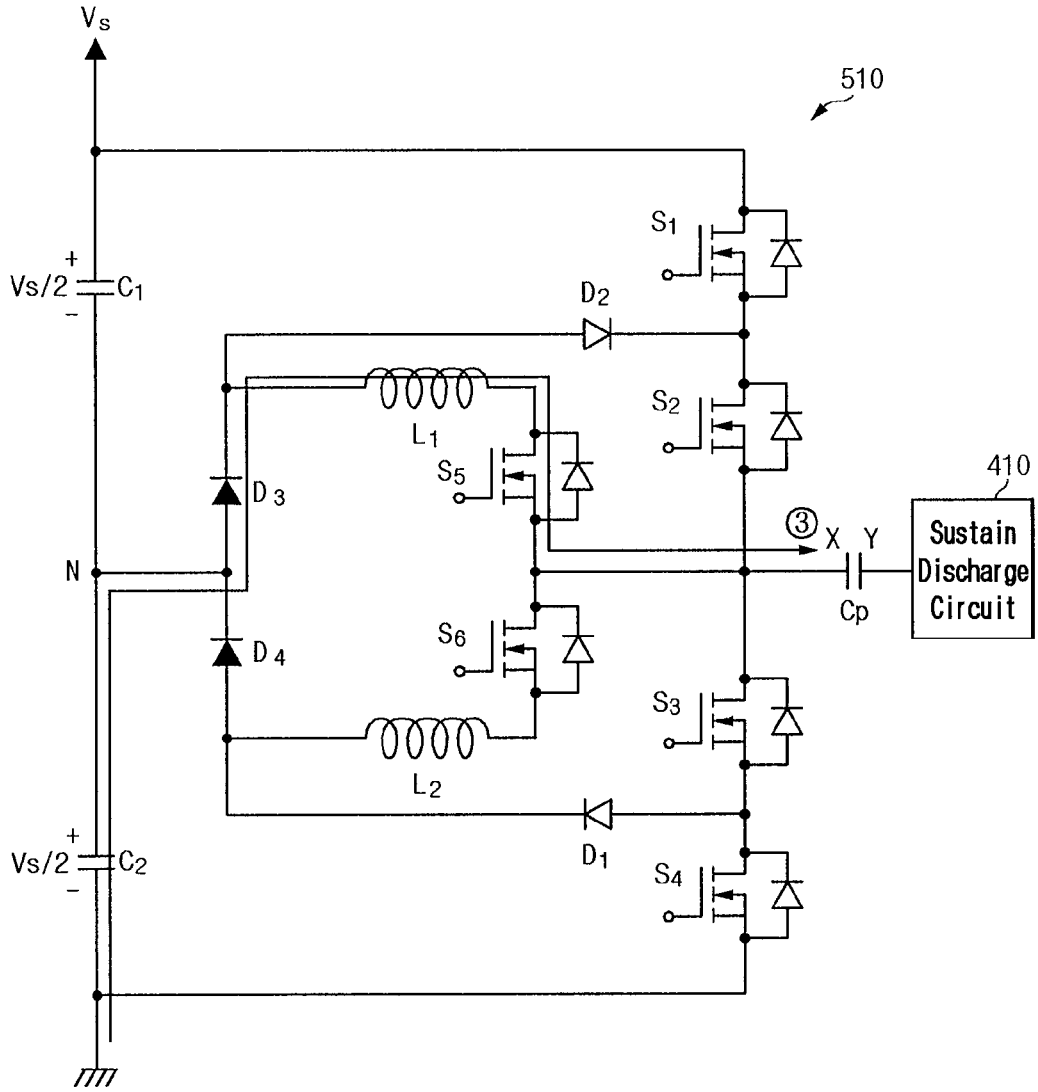

At this time, since a voltage of the drain of the transistor S4 is Vs/2 and a voltage of the source is 0 V, a voltage of Vs/2 or less is applied between the drain and the source of each of the transistors S1 and S4 of turned-off states. That is, it is possible to use the transistors S1 and S4 that have the voltage Vs/2 as an internal voltage. In a third mode M3, in a state in which the transistor S5 is turned on, the transistor S3 is turned off. As a result, as shown in FIG. 5C, resonance is generated again through a resonance path ③ of the capacitor C2, the diode D3, the inductor L1, the transistor S5, and the panel capacitor Cp. Through this resonance, a second voltage rising period during which the voltage Vx of the X electrode rises from the voltage ½Vs to the voltage Vs is generated.

Figure 5D:
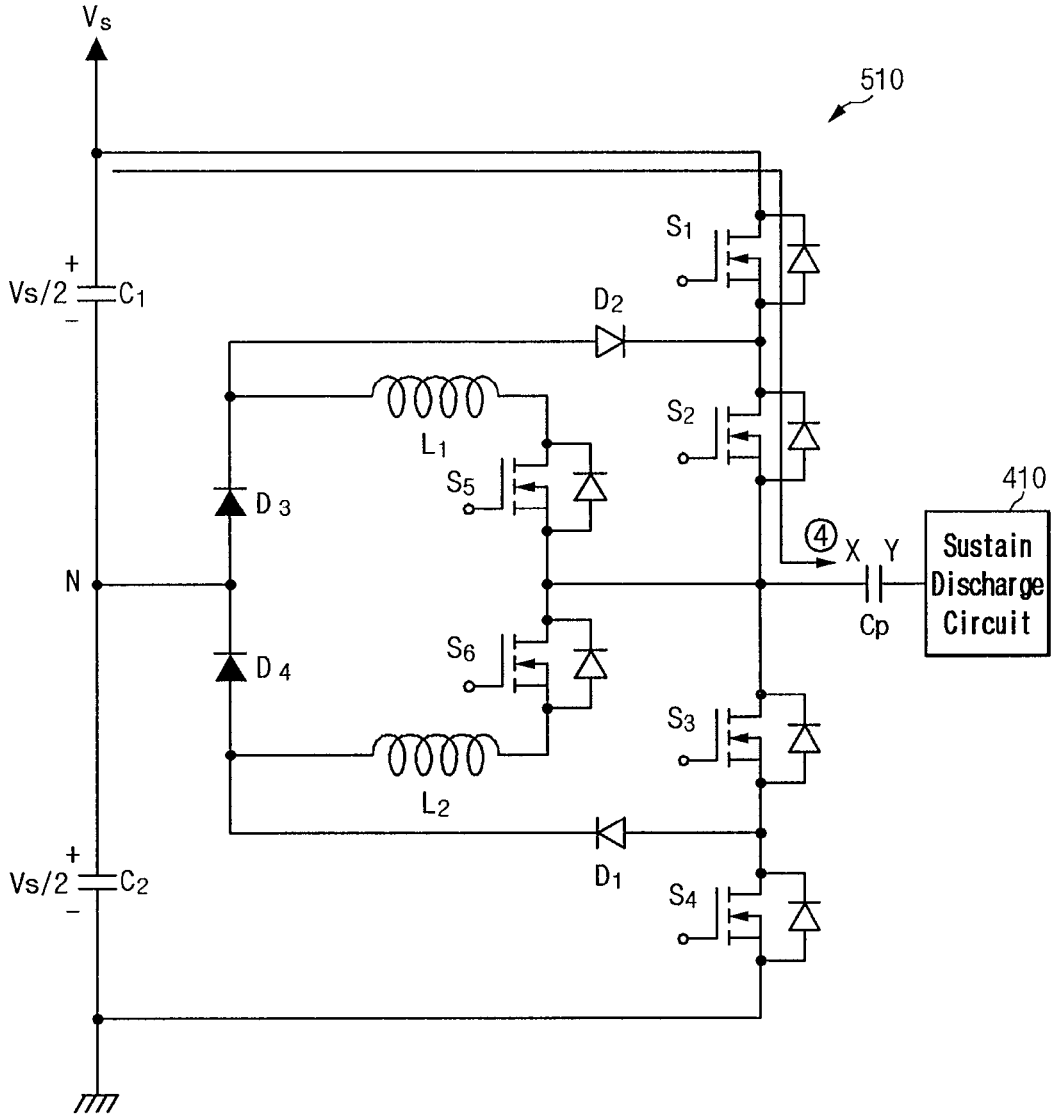

In a fourth mode M4, in a state in which the transistor S2 is turned on, the transistor S5 is turned off, and the transistor S1 is turned on. As shown in FIG. 5D, the voltage Vs is applied to the X electrode through a path ④ of the power supply of Vs the transistor S1, the transistor S2, and the panel capacitor Cp, and the voltage Vx of the X electrode is maintained at the voltage Vs. At this time, the voltage of Vs/2 or less is applied to the transistors S3 and S4 that have been turned off. That is, it is possible to use the transistors S3 and S4 that have the voltage Vs/2 as an internal voltage.

Figure 5E:
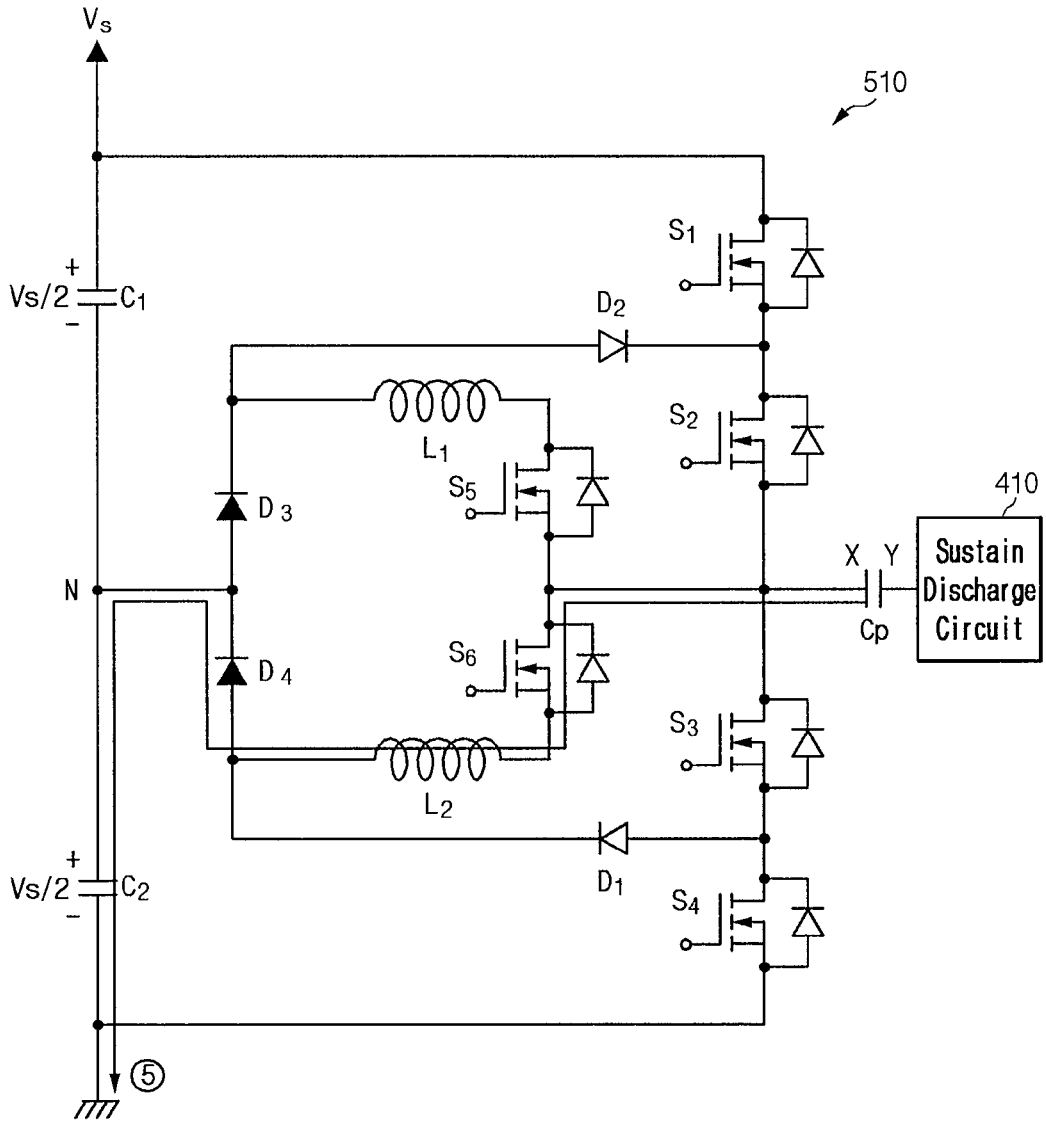

In the fifth mode M5, in a state in which the transistor S2 is turned on, the transistor S1 is turned off, and the transistor S6 is turned on. As shown in FIG. 5E, a resonance path ⑤ of the panel capacitor Cp, the transistor S6, the inductor L2, the diode D4, and the capacitor C2 is formed. As a result, due to resonance, while the energy that is stored in the panel capacitor Cp is recovered by the capacitor C2 through the inductor L2, a first voltage falling period during which the voltage Vx of the X electrode falls from the voltage Vs to the voltage ½Vs is generated.

Figure 5F:
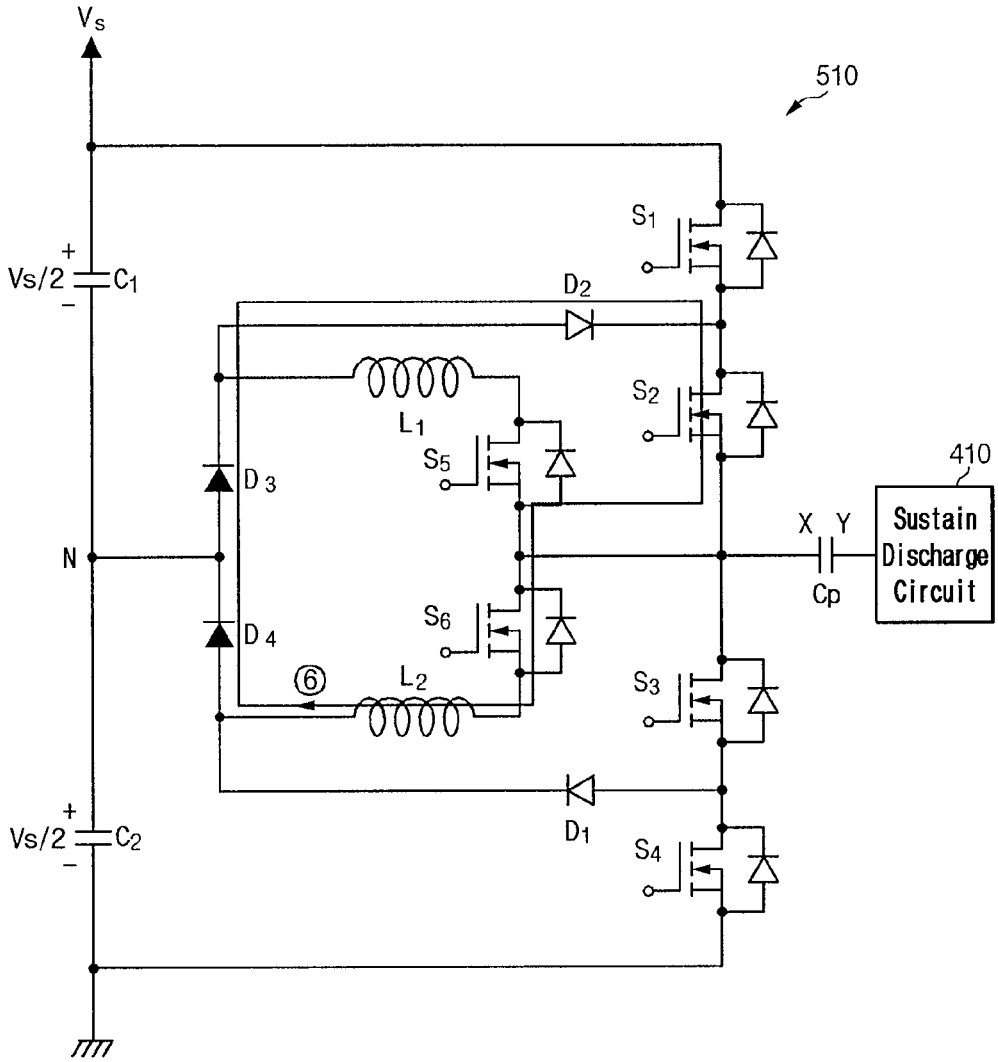

In the sixth mode M6, the transistors S2 and S6 maintain the turned-on state, and the transistor S3 is turned on. As shown in FIG. 5F, if the voltage of the X electrode falls and becomes equal to the voltage Vs/2 charged in the capacitor C2, a current path ⑥ of the transistor S2, the transistor S6, the inductor L2, the diode D4, the diode D3, and the diode D2 is formed through the turned-on transistor S2 and the diode D2 whose cathode is connected to the drain terminal of the transistor S2 and whose anode is connected to the cathode of the diode D4, and the voltage of Vs/2 is maintained. As a result, during a voltage falling period, a voltage sustain period is generated.

At this time, since the source voltage of the transistor S1 is Vs/2 and the drain voltage is Vs, the voltage of Vs/2 or less is applied between the drain and the source of each of the transistors S1 and S4 that have been turned off. That is, it is possible to use the transistors S1 and S4 that have the voltage Vs/2 as an internal voltage.

Figure 5G:
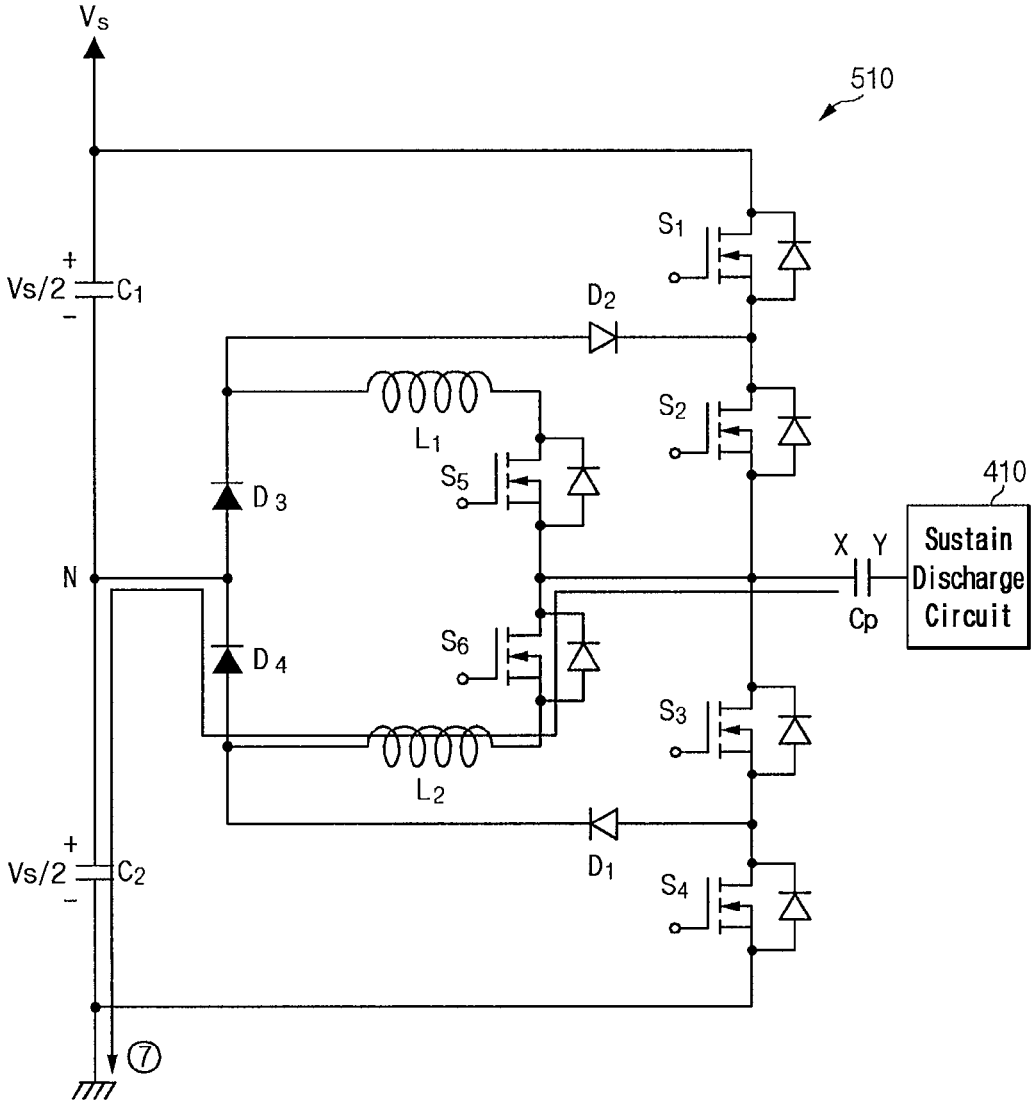

In a seventh mode M7, in a state in which the transistor S6 is turned on, the transistor S2 is turned off, and as shown in FIG. 5G, resonance is generated through a path ⑦ of the panel capacitor Cp, the transistor S6, the inductor L2, the diode D4, and the capacitor C2. While the energy stored in the panel capacitor Cp due to resonance is recovered by the capacitor C2 through the inductor L2, a second voltage falling period is generated during which the voltage Vx of the X electrode falls from the voltage ½Vs to the voltage of 0 V. As a result, the energy remaining in the X electrode is recovered by the capacitor C2.

Figure 5H:
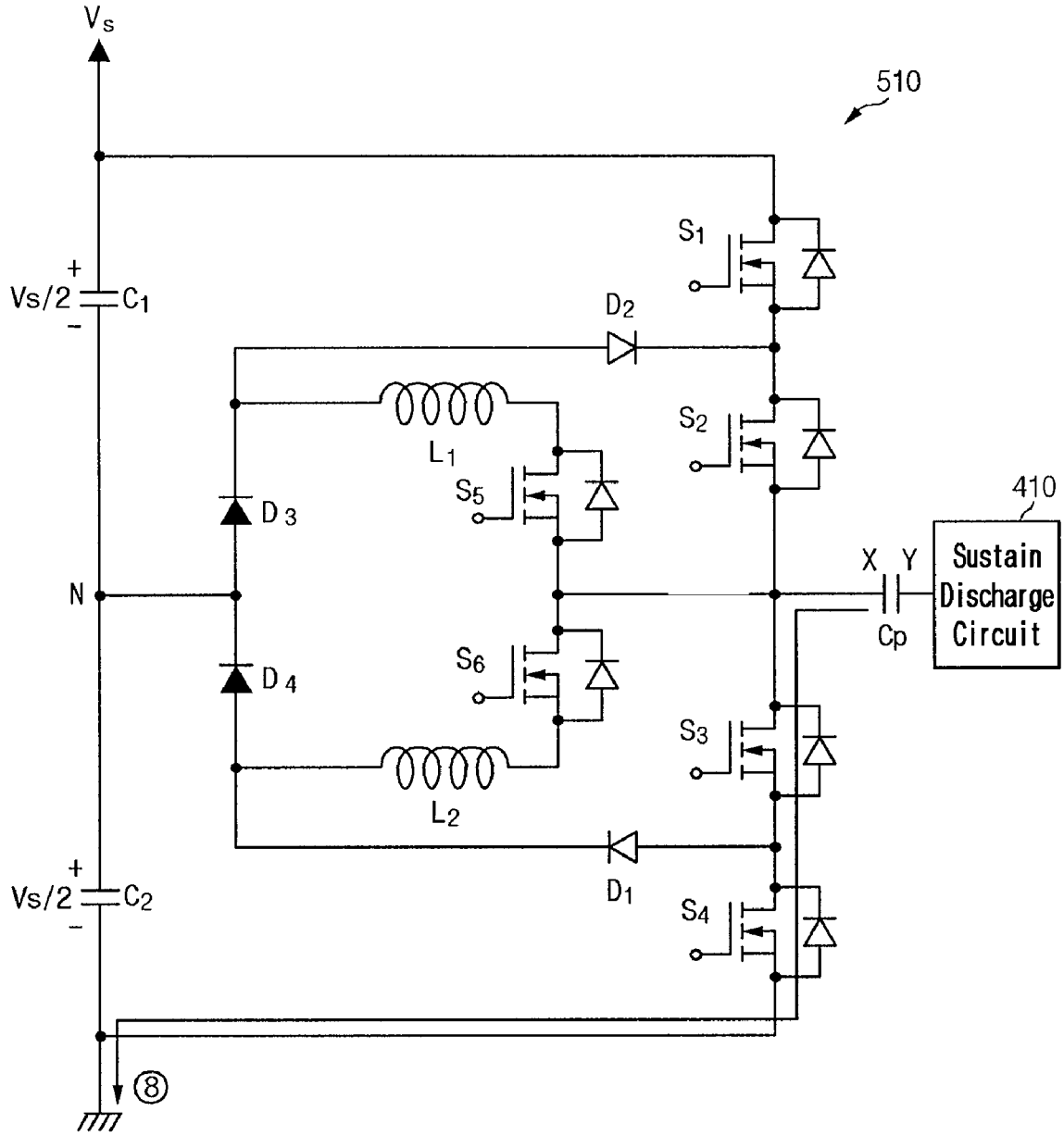

In an eighth mode M8, in a state in which the transistor S3 is turned on, the transistor S6 is turned off, and the transistor S4 is turned on. As a result, as shown in FIG. 5H, the voltage of 0 V as the voltage Vx of the X electrode is applied through a path ⑧ of a power supply of 0 V, the transistor S3, and the transistor S4. At this time, a voltage of Vs/2 or less is applied to the transistors S1 and S2 that have been turned off. That is, it is possible to use the transistors S1 and S2 that have the voltage Vs/2 as an internal voltage.

As such, according to the first exemplary embodiment of the present invention, during the sustain period, the first mode M1 to the eighth mode M8 are repeated by a number of times corresponding to the weight value of the corresponding subfield, and the voltage Vs and the voltage of 0 V may be alternately applied to the X electrode. Meanwhile, according to a process of increasing the voltage of the X electrode, the voltage Vx of the X electrode rises from the voltage of 0 V to the voltage Vs/2 (the first voltage rising period), then the voltage Vs/2 is maintained (voltage sustain period), and the voltage rises again from the voltage Vs/2 to the voltage Vs (the second voltage rising period). Further, according to a process of decreasing the voltage of the X electrode, the voltage Vx of the X electrode falls from the voltage Vs to the voltage Vs/2 (the first voltage falling period), then the voltage Vs/2 is maintained (voltage sustain period), and then voltage falls again from the voltage of Vs/2 to the voltage of 0 V (the second voltage falling period). Accordingly, as compared with a case where the voltage rises from the voltage of 0 V to the voltage Vs and the voltage falls from the voltage Vs to the voltage of 0 V, electro-magnetic interference (EMI) can be reduced.

In addition, the energy applied to the panel capacitor Cp in the first mode M1 can be recovered in the seventh mode M7. In addition, each of the transistors S1, S2, S3, S4, S5, and S6 may be composed of a transistor that has the voltage Vs/2 corresponding to a middle value between the high level voltage Vs and the low level voltage 0 V of the sustain pulse, as an internal value.

Hereinafter, a driving circuit according to another exemplary embodiment of the present invention that applies a sustain pulse of FIG. 2 will be described in detail with reference to FIGS. 6, and 7A to 7H.

Figure 6:
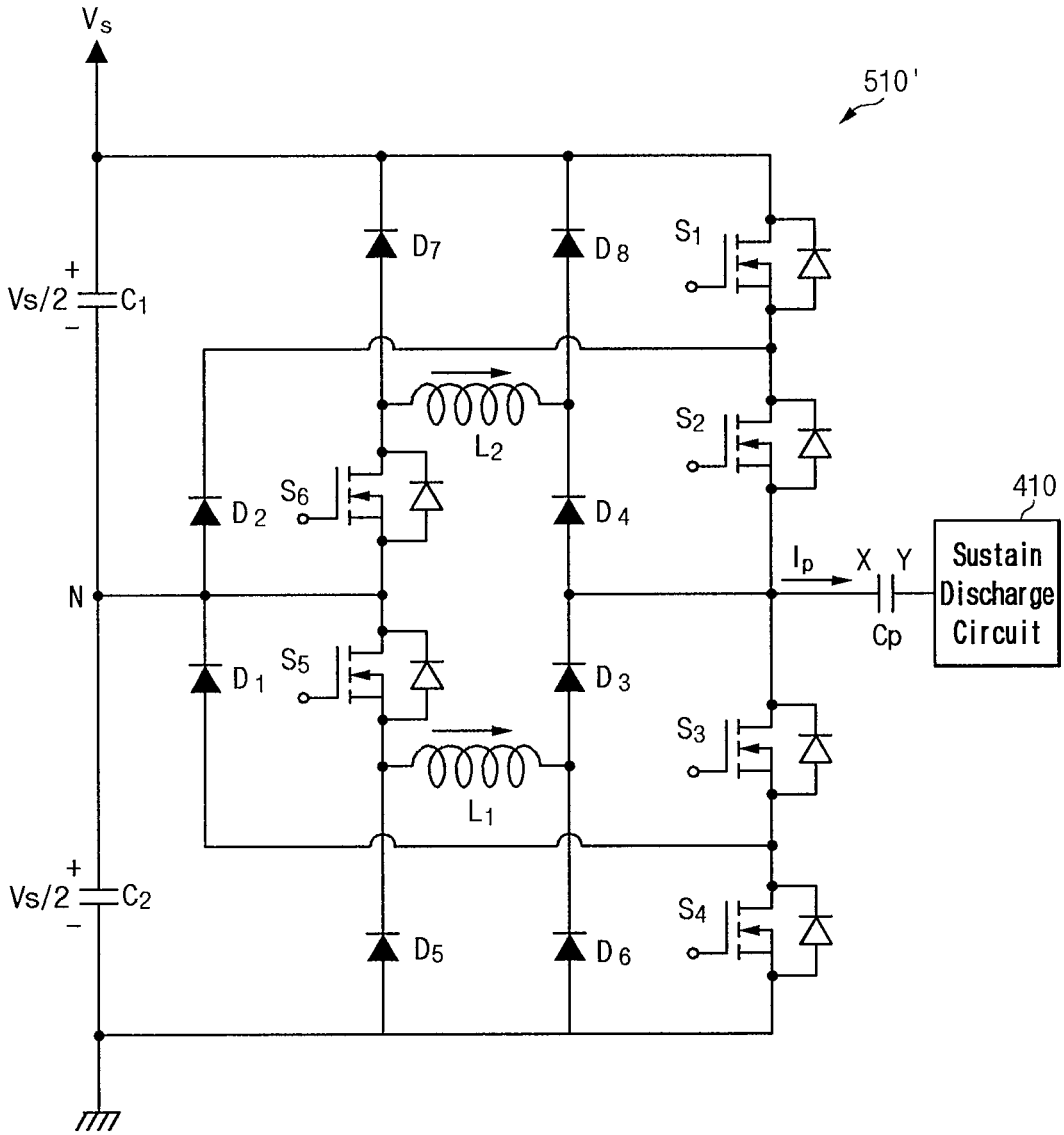
FIG. 6 is a schematic circuit diagram of a sustain discharge circuit according to a second exemplary embodiment of the present invention.

FIG. 6 is a schematic circuit diagram of a sustain discharge circuit 510' according to a second exemplary embodiment of the present invention. FIGS. 7A to 7H are views illustrating the operation of a sustain discharge circuit of FIG. 6 according to the driving signal timing of FIG. 4. The driving signal timing diagram of FIG. 4 may be applied to the second exemplary embodiment of the present invention in the same manner as to the first exemplary embodiment.

Referring to FIG. 6, the second exemplary embodiment is substantially the same as the first exemplary embodiment, except that the contact point between the two capacitors C1 and C2, is connected to the plurality of first electrodes (i.e., X electrodes) through transistors S5, S6, inductors L1, L2 and diodes D3, D4, the terminals of the inductor L2 are connected to the high level voltage terminal through diodes D7, D8, and the terminals of the inductor L1 are connected to the low level voltage terminal through diodes D5 and D6. That is, the second embodiment is substantially the same as the first embodiment in that a voltage rising path and a voltage falling path are formed through the inductors, and a voltage sustaining path is formed including the diode. However, since the difference exists between the specific circuit structures of the first and second embodiments, the difference will now be described.

The transistors S1, S2, S3, and S4 and the capacitors C1 and C2 of FIG. 6 are substantially the same as those of FIG. 3. Also, the structure of FIG. 6 is substantially the same as that of FIG. 3 in that a voltage sustaining path during the voltage rising period is formed through the diode D1 whose anode is connected to a source terminal of the transistor S3 and whose cathode is connected to a node N that is a contact point between the first capacitor C1 and the second capacitor C2, and a voltage sustaining path during the voltage falling period is formed through the diode D2 whose cathode is connected to a drain terminal of the transistor S2 and whose anode is connected to the node N. However, in FIG. 6, a drain of the transistor S5 is connected to the node N, a source thereof is connected to the first terminal of the inductor L1, the second terminal of the inductor is connected to an anode of the diode D3, and the cathode of the diode D3 is electrically connected to the plurality of first electrodes. In addition, a source of the transistor S6 is connected to the node N, a drain thereof is connected to the first terminal of the inductor L2, the second terminal of the inductor L2 is connected to the cathode of the diode D4, and the anode of the diode D4 is electrically connected to the plurality of first electrodes. Also, the first terminal of the inductor L1 is connected to the cathode of the diode D5, and the anode of the diode D5 is electrically connected to the low level voltage terminal. The second terminal of the inductor L1 is connected to the cathode of the diode D6, and the anode of the diode D6 is electrically connected to the low level voltage terminal. The first terminal of the inductor L2 is connected to the anode of the diode D7, and the cathode of the diode D7 is electrically connected to the high level voltage terminal. The second terminal of the inductor L2 is connected to the anode of the diode D8, and the cathode of the diode D8 is electrically connected to the high level voltage terminal.

Next, the operation of the sustain discharge circuit 510' of FIG. 6 will be described in detail with reference to FIGS. 4, and 7A to 7H.

FIG. 4 is a signal timing diagram of the sustain discharge circuit 510', and FIGS. 7A to 7H are views illustrating the operation of the sustain discharge circuit 510' of FIG. 6 according to the signal timing of FIG. 4.

First, right before a first mode M1 of FIG. 4 (that is, during a previous mode M8), it is assumed that the transistors S3 and S4 are turned on, and the voltage Vx of the X electrode is maintained at a voltage of 0 V.

Figure 7A:
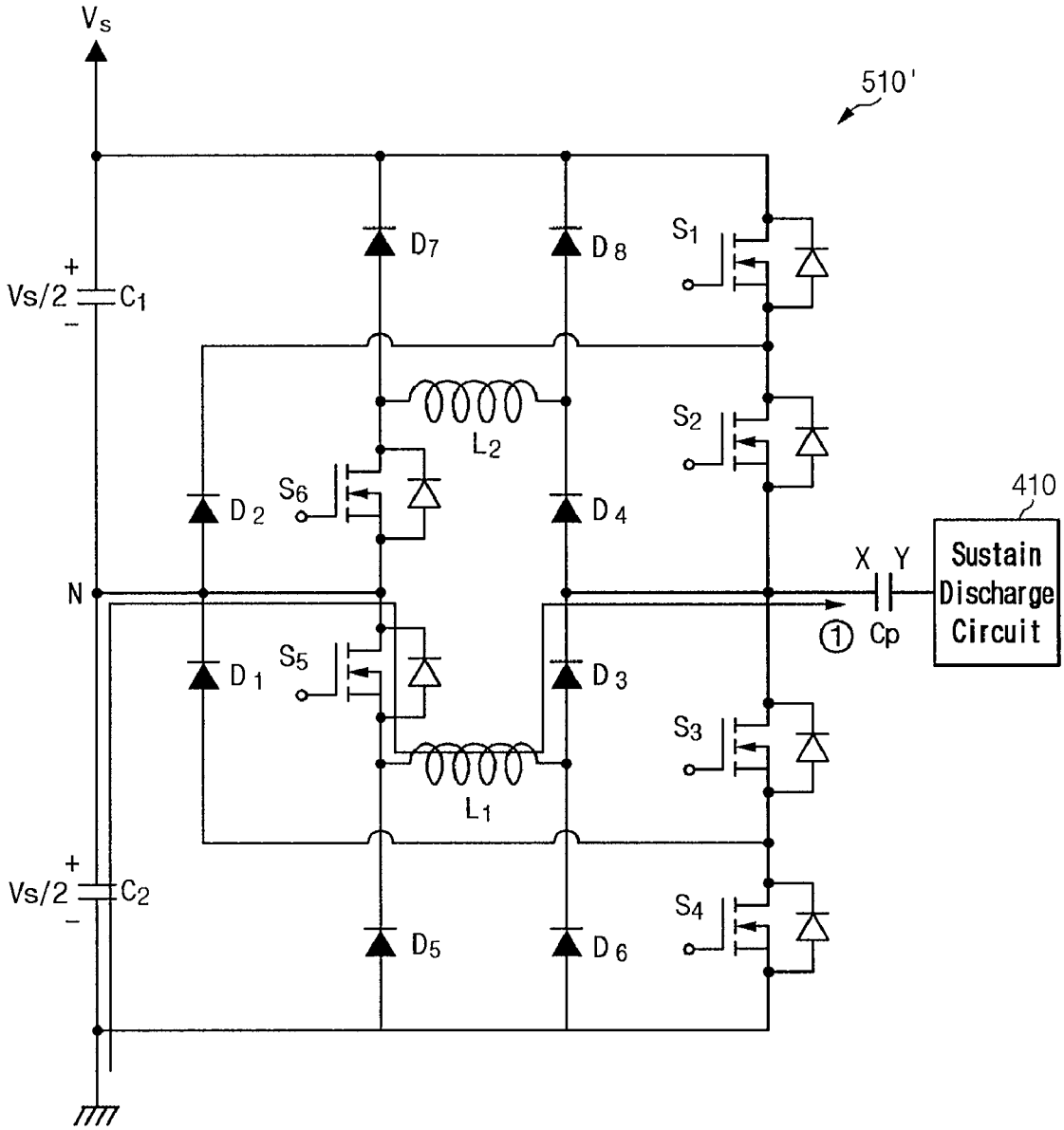
FIGS. 7A to FIG. 7H are views illustrating the operation of a sustain discharge circuit of FIG. 6 according to a signal timing of FIG. 4.

Referring to FIGS. 4 and 7A, in a state in which the transistor S3 is turned on in the first mode M1, the transistor S4 is turned off, and the transistor S5 is turned on. Then, as shown in FIG. 7A, the inductor L1 forms a resonance path ① through the capacitor C2, the transistor S5, the inductor L1, the diode D3, and the panel capacitor Cp, and energy charged in the capacitor C2 through the resonance path is applied to the X electrode through the inductor L1, which forms a first voltage rising period during which the voltage Vx of the X electrode rises from the voltage of 0 V to the voltage Vs/2.

Figure 7B:
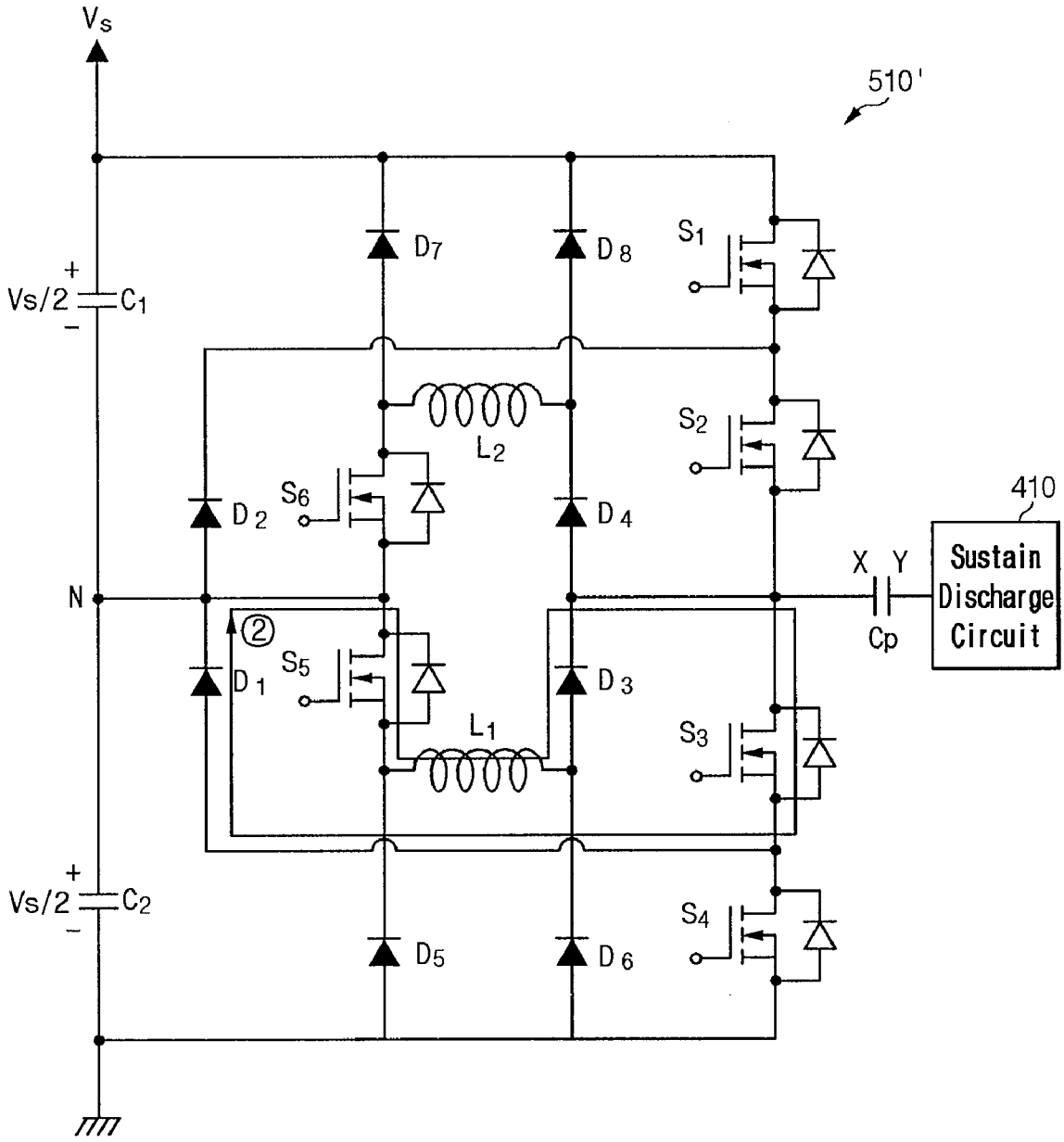

In a second mode M2, the transistors S3 and S5 maintain turn-on states, and the transistor S2 is turned on. As shown in FIG. 7B, if the voltage at the X electrode rises and becomes equal to the voltage Vs/2 charged in the capacitor C2, a current path ② of the transistor S3, the diode D1, the transistor S5, the inductor L1, and the diode D3 is formed through the transistor S3 of a turned-on state, and the diode D1 whose anode is connected to the source of the transistor S3 and whose cathode is connected to a contact point. The voltage of Vs/2 is maintained. As a result, during the voltage rising period, a voltage sustain period is generated.

At this time, since a voltage of the drain of the transistor S4 is Vs/2 and a voltage of the source thereof is 0 V, a voltage of Vs/2 or less is applied between the drain and the source of each of the transistors S1 and S4 of a turned-off state. That is, it is possible to use the transistors S1 and S4 that have the voltage Vs/2 as an internal voltage.

Figure 7C:
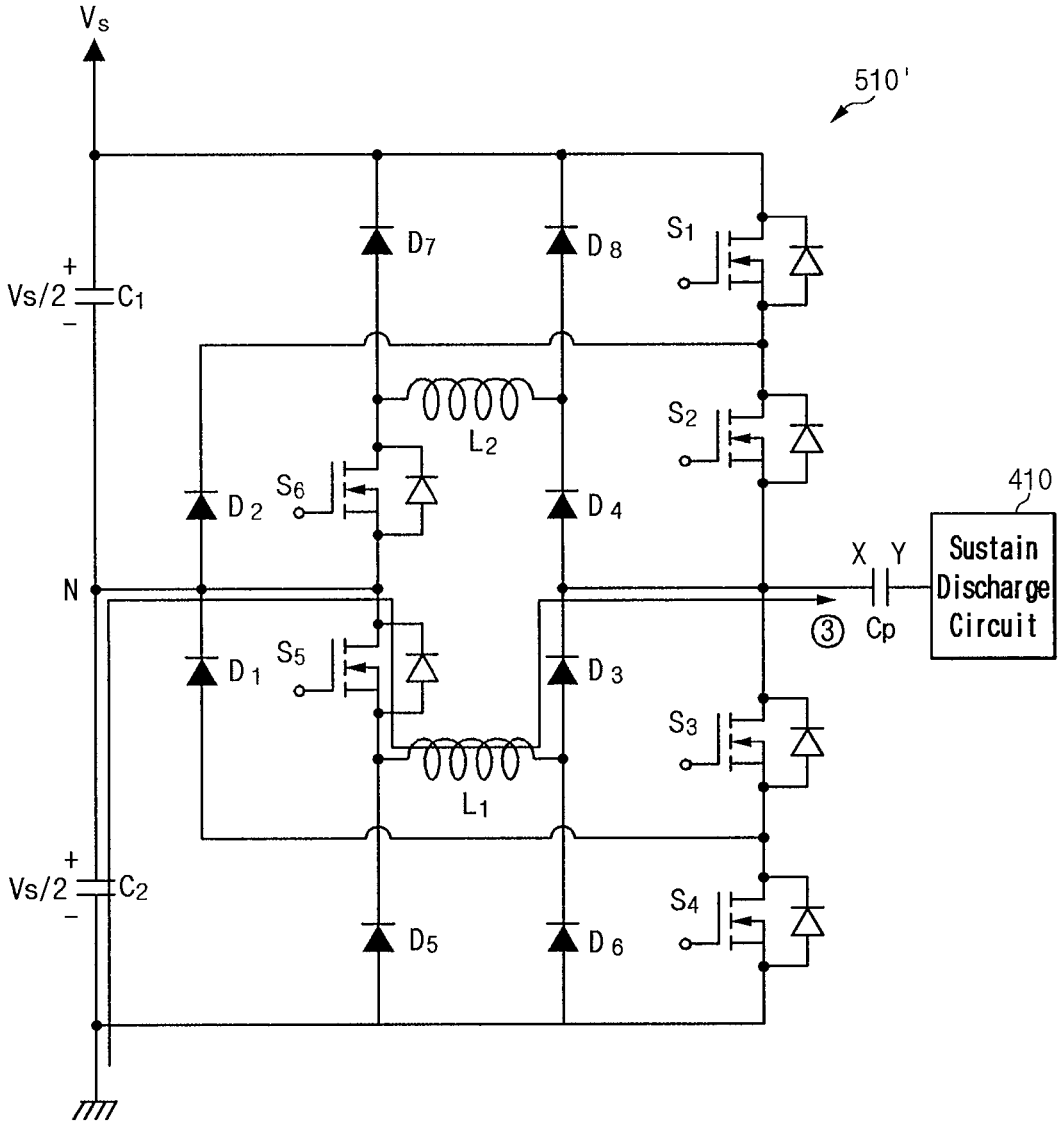

In a third mode M3, in a state in which the transistors S2 and S5 are turned on, the transistor S3 is turned off. As a result, as shown in FIG. 7C, resonance is generated again through a resonance path ③ of the capacitor C2, the transistor S5, the inductor L1, the diode D3, and the panel capacitor Cp. Due to resonance, a second voltage rising period during which the voltage Vx of the X electrode rises from the voltage ½Vs to the voltage Vs is generated.

Figure 7D:
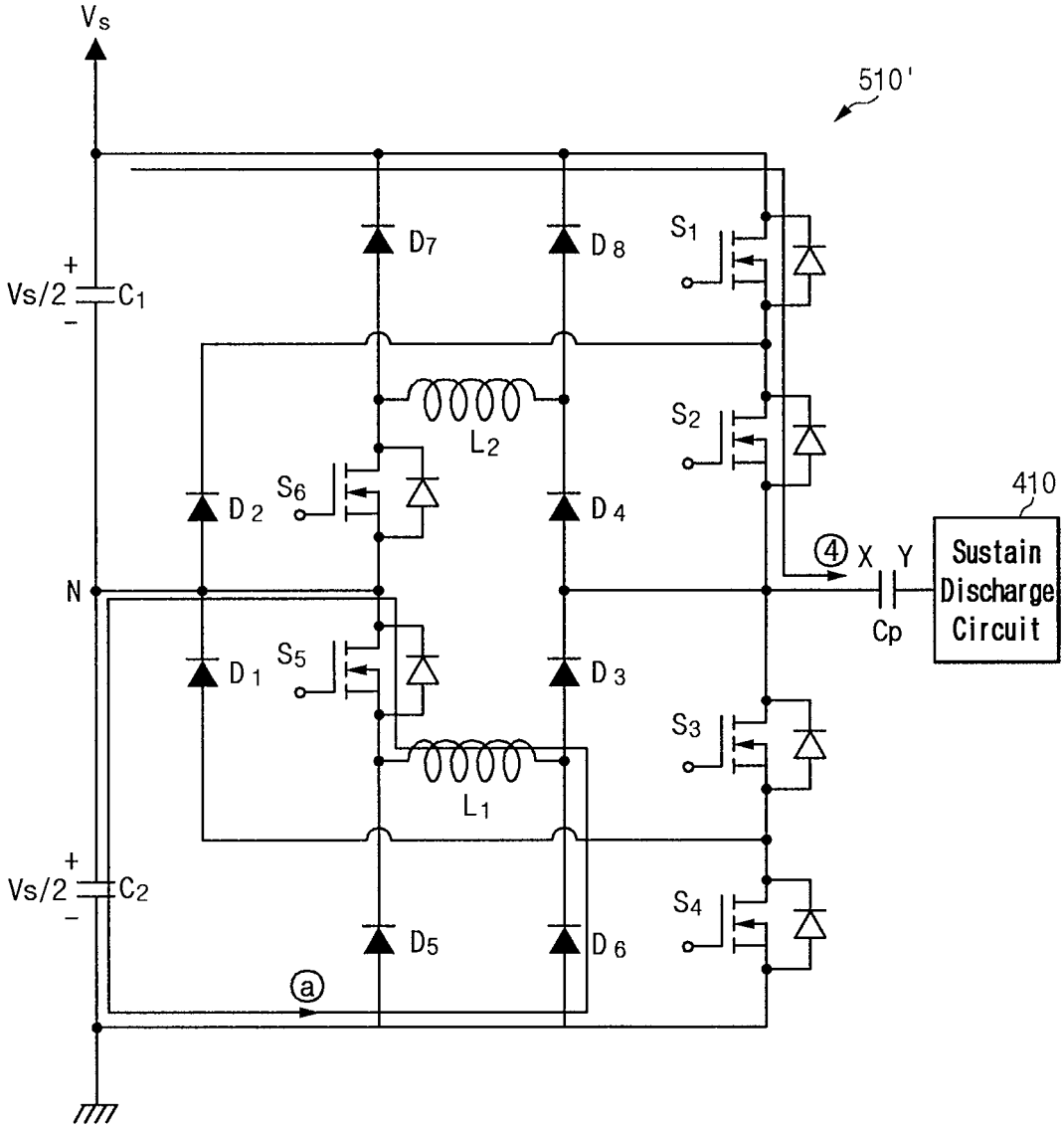

In a fourth mode M4, in a state in which the transistor S2 is turned on, the transistor S5 is turned off, and the transistor S1 is turned on. As shown in FIG. 7D, the voltage Vs is applied to the X electrode through a path ④ of the power supply of Vs, the transistor S1, the transistor S2, and the panel capacitor Cp, and the voltage Vx of the X electrode is maintained at the voltage Vs. Further, as the transistor S1 is turned on, the inductor L1 is separated from the power supply of Vs power supply due to the diode D3, which generates a backward current. The backward current is rapidly reduced through a path (a) of the diode D6, the inductor L1, the body diode of the transistor S5, and the capacitor C2. At this time, a voltage of Vs/2 or less is applied to the turned-off transistors S3 and S4. That is, it is possible to use the transistors S3 and S4 that have the voltage Vs/2 as an internal voltage.

Figure 7E:
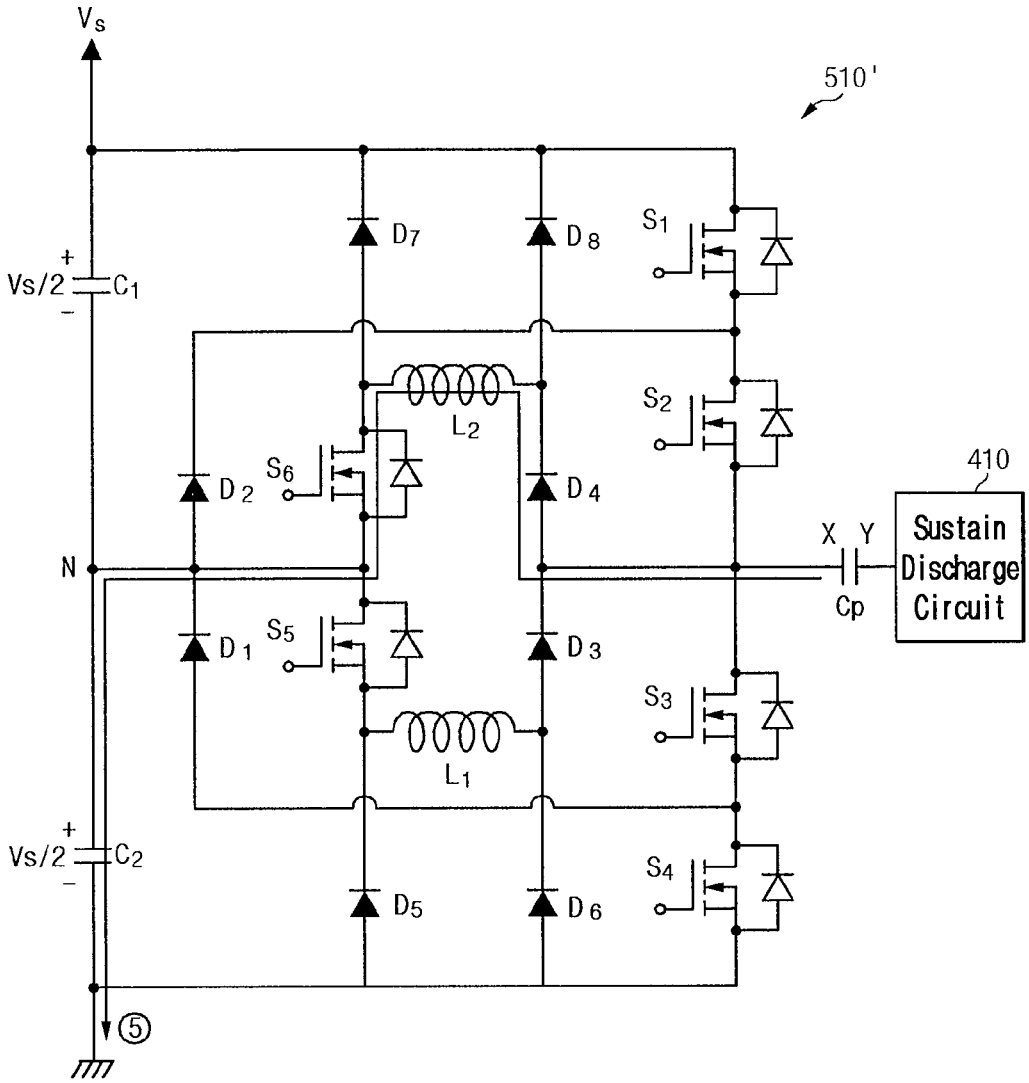

In the fifth mode M5, in a state in which the transistor S2 is turned on, the transistor S1 is turned off, and the transistor S6 is turned on. As shown in FIG. 7E, a resonance path ⑤ of the panel capacitor Cp, the diode D4, the inductor L2, the transistor S6, and the capacitor C2 is formed. As a result, due to resonance, while the energy that is stored in the panel capacitor Cp through the resonance is recovered by the capacitor C2 through the inductor L2, a first voltage falling period during which the voltage Vx of the X electrode falls from the voltage Vs to the voltage ½Vs is generated.

Figure 7F:
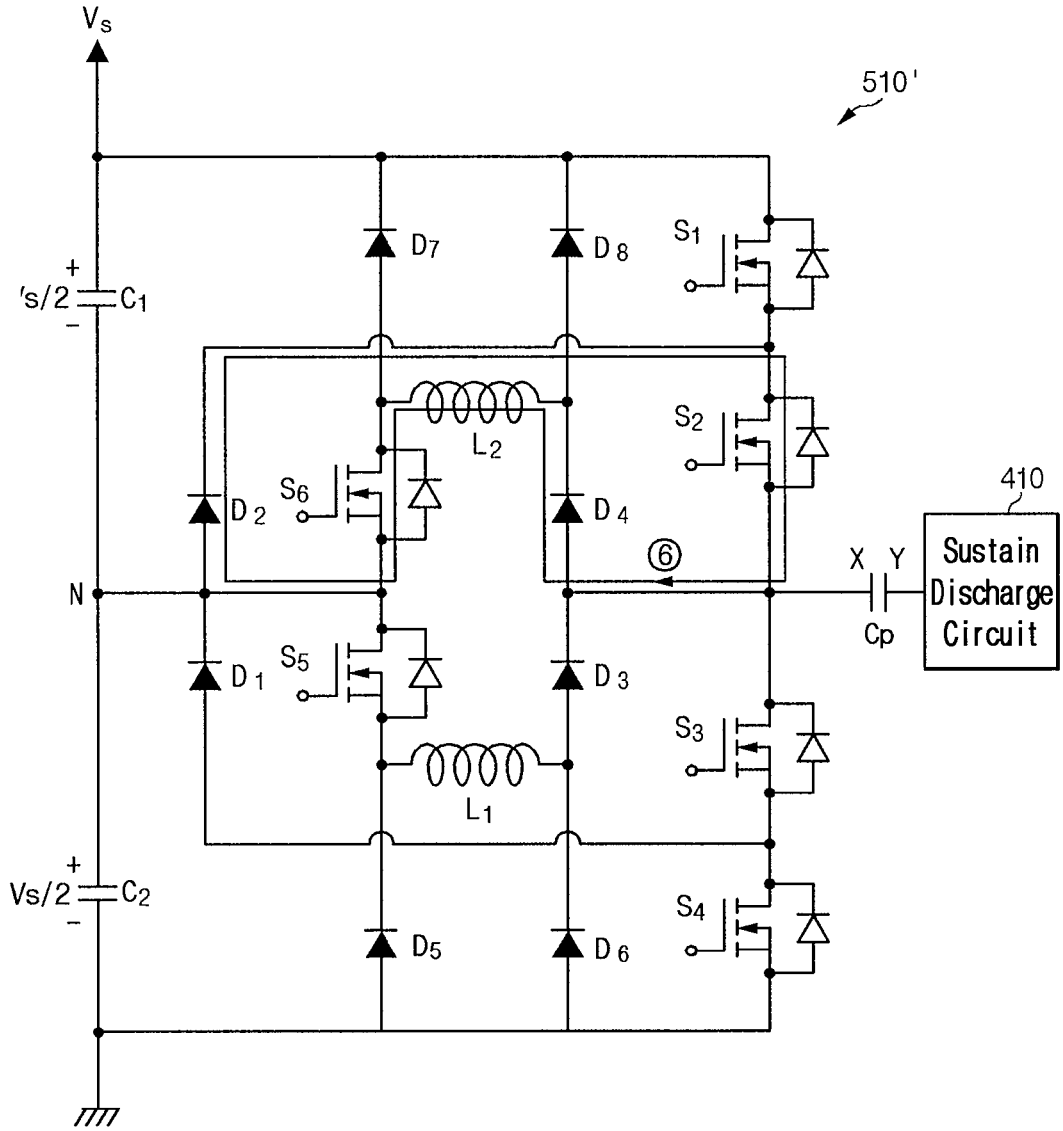

In the sixth mode M6, the transistors S2 and S6 maintain the turned-on state, and the transistor S3 is turned on. As shown in FIG. 7F, if the voltage at the X electrode falls and becomes equal to the voltage Vs/2 charged in the capacitor C2, a current path ⑥ of the transistor S2, the diode D4, the inductor L2, the transistor S6, and the diode D2 is formed through the turned-on transistor S2 and the diode D2 whose cathode is connected to the drain terminal of the transistor S2 and whose anode is connected to the contact point, and the voltage of Vs/2 is maintained. As a result, during a voltage falling period, a voltage sustain period is generated.

At this time, since the source voltage of the transistor S1 is the voltage Vs/2 and the drain voltage thereof is the voltage Vs, the voltage of Vs/2 or less is applied between the drain and the source of each of the transistors S1 and S4 that have been turned off. That is, it is possible to use the transistors S1 and S4 that have the voltage Vs/2 as an internal voltage.

Figure 7G:
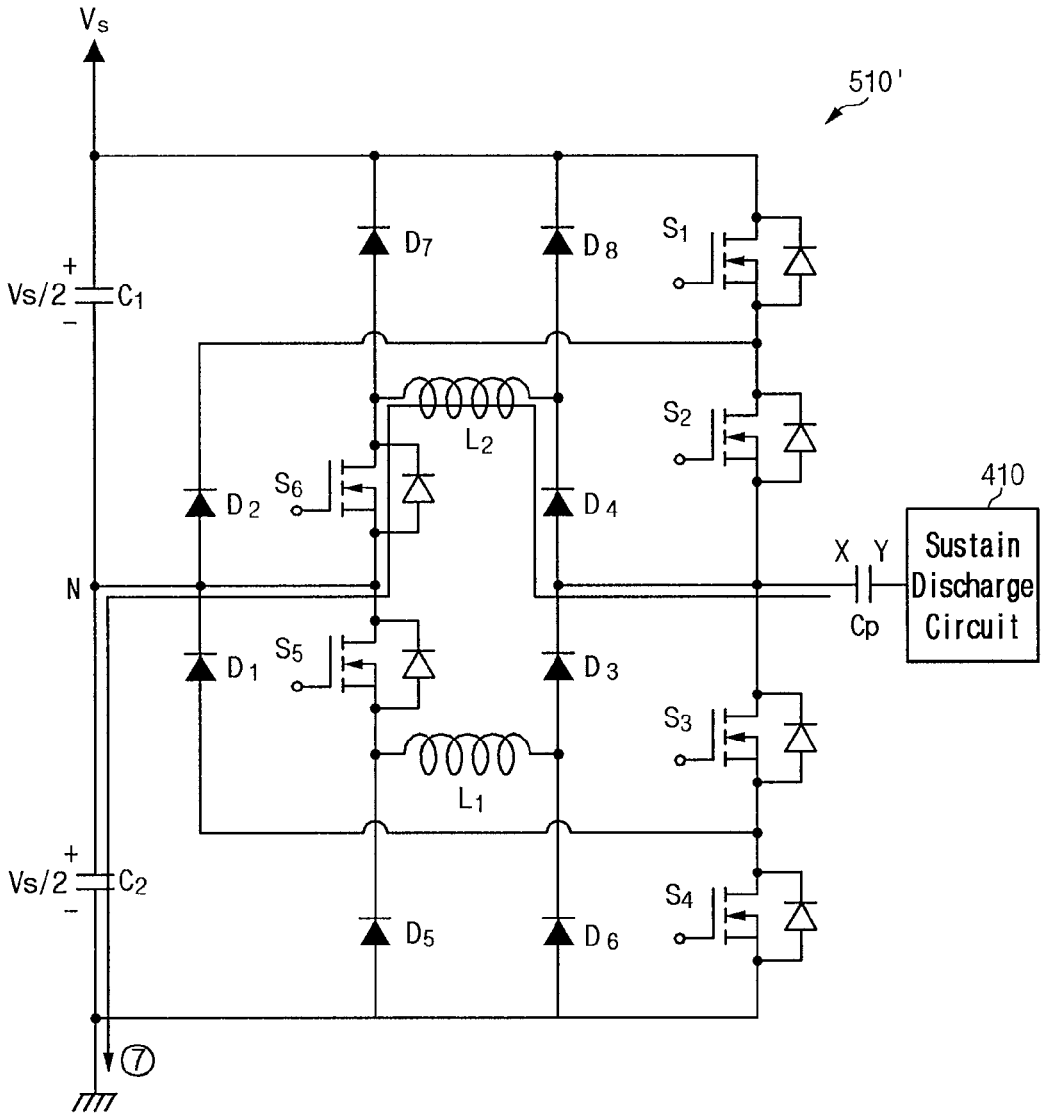

In a seventh mode M7, in a state in which the transistors S3 and S6 are turned on, the transistor S2 is turned off, and as shown in FIG. 7G, resonance is generated through a path ⑦ of the panel capacitor Cp, the diode D4, the inductor L2, the transistor S6, and the capacitor C2. Due to the resonance, while energy stored in the panel capacitor Cp is recovered by the capacitor C2 through the inductor L2, a second voltage falling period during which the voltage Vx of the X electrode falls from the voltage ½Vs to the voltage of 0 V is generated. As a result, the energy remaining in the X electrode is recovered by the capacitor C2.

Figure 7H:
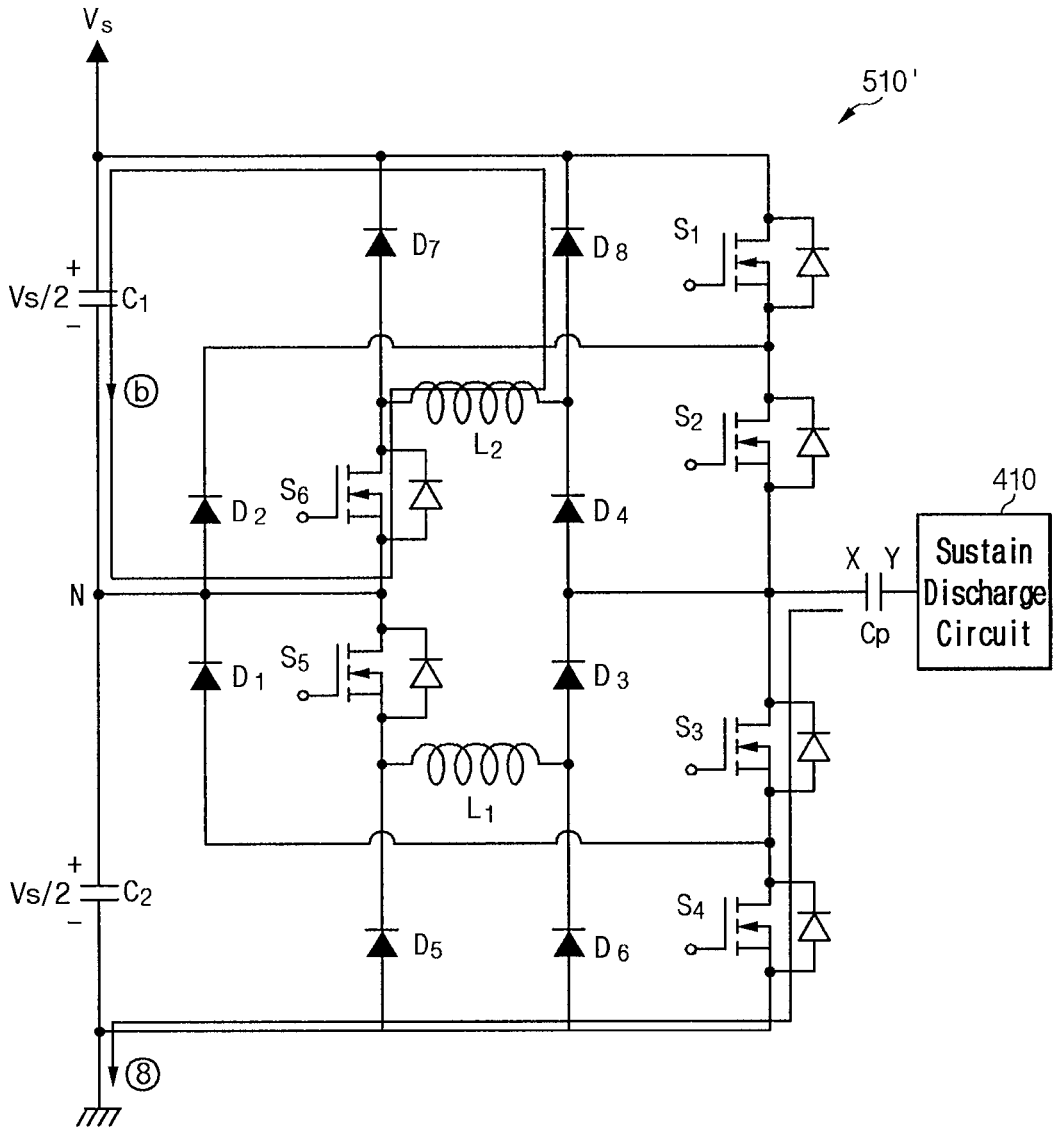

In an eighth mode M8, as illustrated in FIG. 7H, in a state in which the transistor S3 is turned on, the transistor S6 is turned off, and the transistor S4 is turned on. As a result, the voltage of 0 V is applied through a path ⑧ of a power supply of 0 V, the transistor S4, and the transistor S3 as the voltage Vx of the X electrode. Further, as the transistor S4 is turned on, the inductor L2 is separated from the ground power supply due to the diode D4, which generates a backward current. The backward current is rapidly reduced through a path ⓑ of the body diode of the transistor S6, the inductor L2, the diode D8, and the capacitor C1. At this time, a voltage of Vs/2 or less is applied to the transistors S1 and S2 that have been turned off. That is, it is possible to use the transistors S1 and S2 that have the voltage Vs/2 as an internal voltage.

So far, the first and the second exemplary embodiments of the present invention have been described with reference to the signal timing diagram of FIG. 4. FIG. 4 shows an operation structure where the transistor S2 is turned on in the second mode M2, while being turned off in the seventh mode M7. However, even when an operation structure where the transistor S2 is turned on in the third mode M3, while being turned off in the sixth mode M6, is used, it is possible to achieve the same operation and effect.

Further, the first and the second exemplary embodiments have been described where the high level voltage and the low level voltage are respectively Vs and 0 V. However, if the difference between the high level voltage and the low level voltage can maintain the sustain discharge voltage, the two voltage levels can be changed.

As described above, in the first and the second exemplary embodiments of the present invention, a case where the sustain pulse that alternately has a high level voltage and a low level voltage is applied to the X electrode and the Y electrode in a reversed phase has been described. However, the sustain pulse may be applied to either the X electrode or the Y electrode. Hereinafter, these exemplary embodiments will be described in detail with reference to FIGS. 8, 9, and 10.

Figure 8:
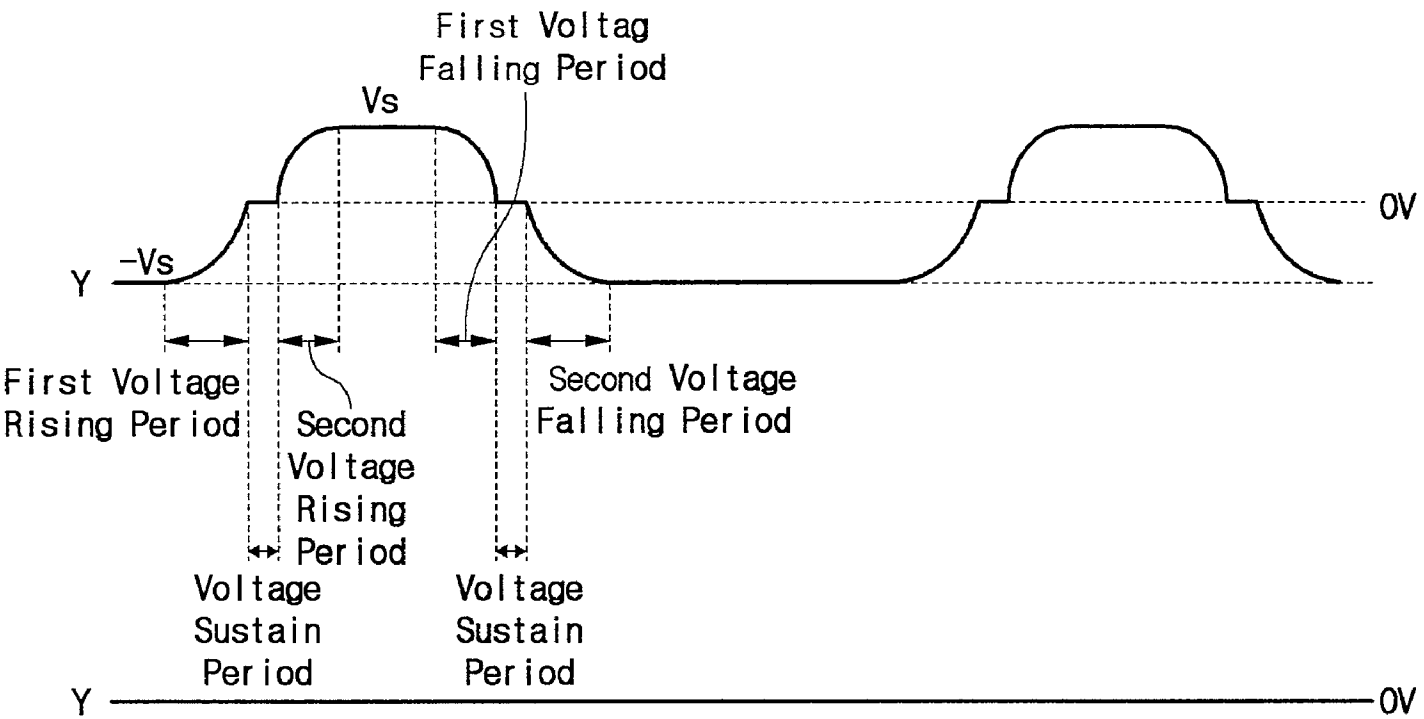
FIG. 8 is a view illustrating a sustain pulse according to a third exemplary embodiment of the present invention.

FIG. 8 is a view illustrating a sustain pulse according to a third exemplary embodiment of the present invention. As shown in FIG. 8, according to the third exemplary embodiment of the present invention, during the sustain period, a sustain pulse that alternately has a voltage Vs and a voltage −Vs is applied to a plurality of X electrodes X1 to Xn, and a voltage of 0 V is applied to a plurality of Y electrodes Y1 to Yn. In addition, when the voltage rises from the voltage −Vs to the voltage Vs and then falls from the voltage Vs to the voltage −Vs, a period is generated for maintaining a voltage of 0 V corresponding to a middle level voltage between the voltage Vs and the voltage −Vs. That is, the voltage rising period of the sustain pulse includes the first voltage rising period (−Vs->0 V), the voltage sustain period 0 V, and the second voltage rising period (0 V->Vs), and the voltage falling period includes the first voltage falling period (Vs->0 V), the voltage sustain period 0 V, and the second voltage falling period (0 V->Vs).

Figure 9:
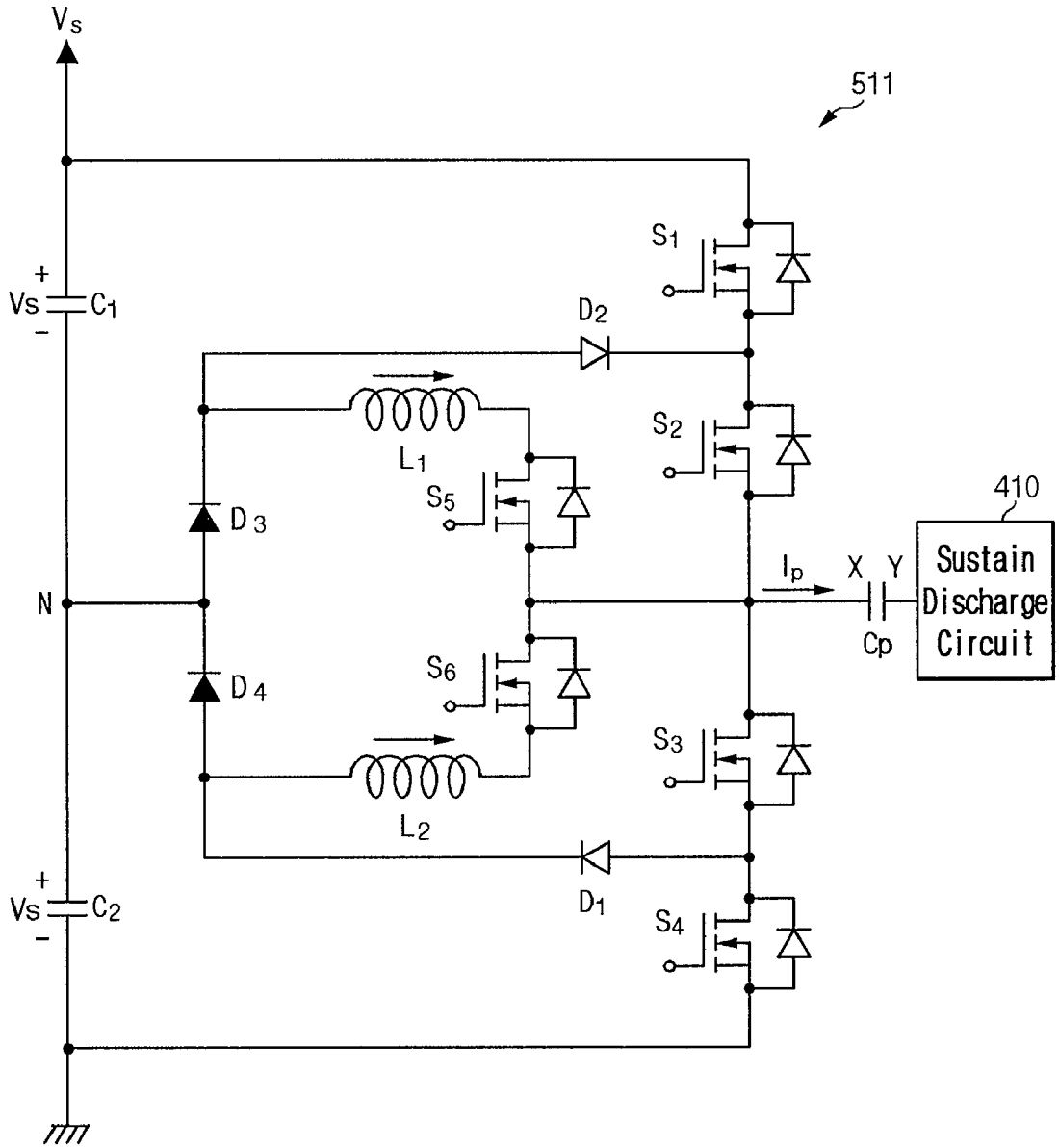
FIG. 9 is a schematic circuit diagram of a sustain discharge circuit according to the third exemplary embodiment of the present invention.

FIG. 9 is a schematic circuit diagram of a sustain discharge circuit according to a third exemplary embodiment of the present invention. In the third exemplary embodiment of the present invention, the sustain pulse of FIG. 8 is implemented, and the signal timing diagram of the sustain discharge circuit 510' of FIG. 4 is used.

Referring to FIG. 9, the sustain discharge circuit 511 of the third exemplary embodiment is substantially the same as that of the first exemplary embodiment, except for the low level voltage, and the voltage charged in the capacitors C1 and C2.

Specifically, the drain of the transistor S1 is connected to a power supply that supplies a high level voltage Vs of a sustain pulse. At this time, the power supply Vs may be supplied by a capacitor that is connected to an output terminal of a switching mode power supply (SMPS), which is not shown. A source of the transistor S1 is connected to a drain of the transistor S2, and a source of the transistor S2 is connected to an X electrode. A drain of the transistor S3 is connected to the X electrode, and a source thereof is connected to a drain of the transistor S4. The source of the transistor S4 is connected to a power supply that supplies a low level voltage −Vs of a sustain pulse. A first terminal of the capacitor C1 that charges a voltage Vs corresponding to half of the voltage difference between the high level voltage Vs and the low level voltage −Vs of a sustain pulse is connected to the power supply that supplies the high level voltage Vs of a sustain pulse, and a second terminal thereof is connected to a first terminal of the capacitor C2 that charges the voltage Vs corresponding to half of the voltage difference between the high level voltage Vs and the low level voltage −Vs of the sustain pulse. A second terminal of the capacitor C2 is connected to the power supply that supplies the low level voltage −Vs of the sustain pulse. A cathode of a diode D3 whose anode is connected to a node N corresponding to a contact point between the two capacitors C1 and C2 is connected to a first terminal of an inductor L1, and a second terminal of the inductor L1 is connected to a drain of the transistor S5. An anode of a diode D4 whose cathode is connected to the node N is connected to a first terminal of an inductor L2, and a second terminal of the inductor L2 is connected to a source of the transistor S6. Further, the diode D1 has an anode that is connected to the source of the transistor S3 and a cathode that is connected to the anode of the diode D4, and the diode D2 has a cathode that is connected to the drain of the transistor S2 and an anode that is connected to the cathode of the diode D3.

Figure 10:
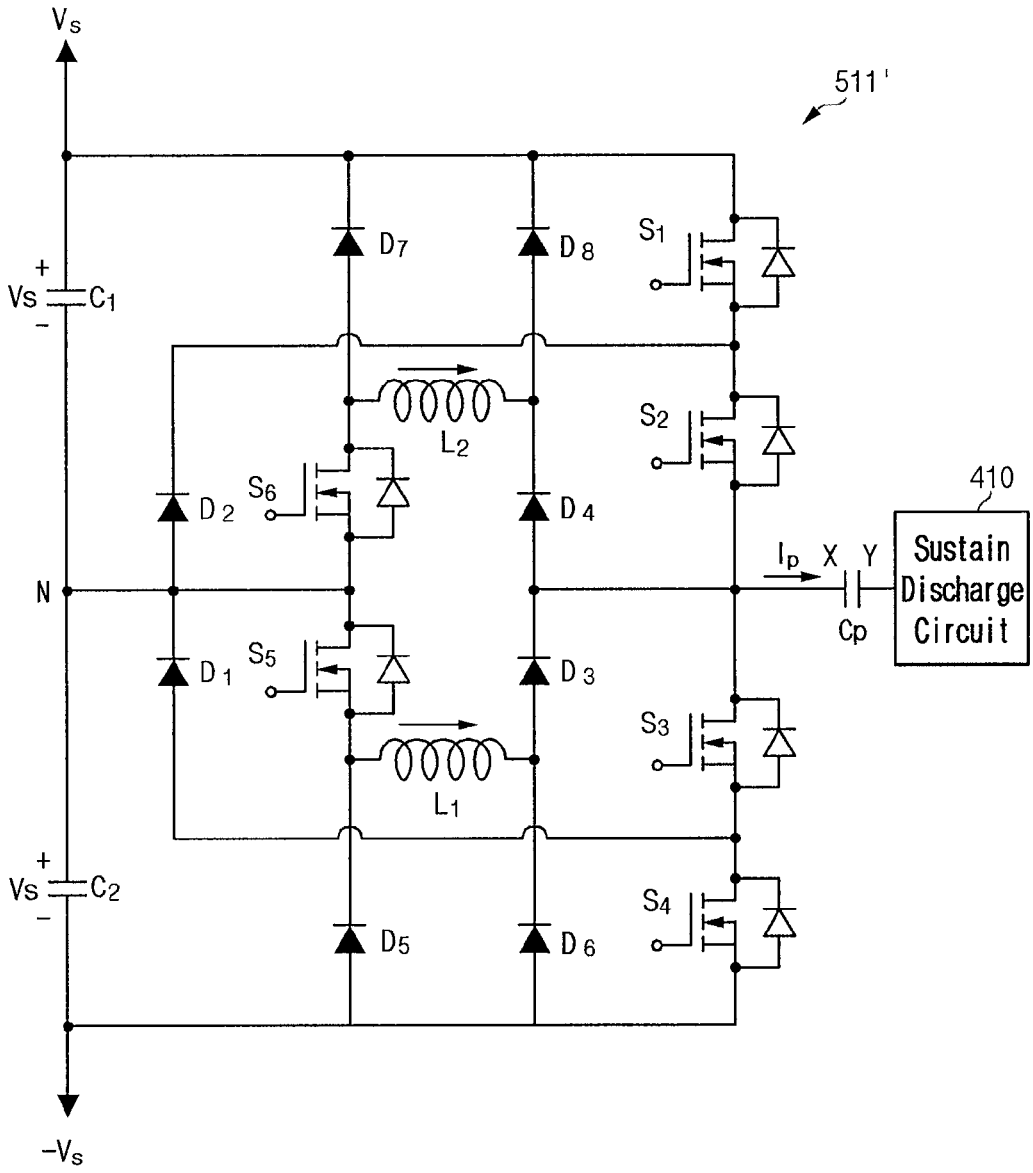
FIG. 10 is a schematic circuit diagram of a sustain discharge circuit according to a fourth exemplary embodiment of the present invention.

FIG. 10 is a schematic circuit diagram of a sustain discharge circuit according to a fourth exemplary embodiment of the present invention. According to the fourth exemplary embodiment of the present invention, the sustain pulse of FIG. 8 is implemented, and the signal timing diagram of the sustain discharge circuit 510' of FIG. 4 is used.

Referring to FIG. 10, in the operation according to the fourth exemplary embodiment of the present invention, the sustain discharge circuit 511' according to the fourth exemplary embodiment of the present invention is substantially the same as that of the second exemplary embodiment of the present invention of FIG. 6, except for the low level voltage, and the voltage charged in the capacitors C1 and C2.

Specifically, the drain of the transistor S1 is connected to a power supply that supplies a high level voltage Vs of a sustain pulse. The power supply Vs may be supplied by a capacitor that is connected to an output terminal of a switching mode power supply (SMPS), which is not shown. A source of the transistor S1 is connected to a drain of the transistor S2, and a source of the transistor S2 is connected to an X electrode. A drain of the transistor S3 is connected to the X electrode, and a source thereof is connected to a drain of the transistor S4. The source of the transistor S4 is connected to a power supply that supplies a low level voltage −Vs of a sustain pulse, that is, a ground voltage 0 V. A first terminal of the capacitor C1 that charges a voltage Vs corresponding to half of the voltage difference between the high level voltage Vs and the low level voltage −Vs of a sustain pulse is connected to a power supply that supplies a high level voltage Vs of a sustain pulse, and a second terminal thereof is connected to a first terminal of the capacitor C2 that charges a voltage Vs corresponding to half of the voltage difference between a high level voltage Vs and a low level voltage −Vs of the sustain pulse. A second terminal of the capacitor C2 is connected to a power supply that supplies a low level voltage −Vs of a sustain pulse. The drain of the transistor S5 is connected to a node N corresponding to a contact point between the first capacitor C1 and the second capacitor C2, a source thereof is connected to a first terminal of the inductor L1, a second terminal of the inductor L1 is connected to an anode of the diode D3, and the cathode of the diode D3 is electrically connected to the plurality of first electrodes (i.e., X electrodes). In addition, a source of the transistor S6 is connected to the node N, a drain thereof is connected to a first terminal of the inductor L2, the second terminal of the inductor L2 is connected to a cathode of the diode D4, and the anode of the diode D4 is electrically connected to the plurality of first electrodes (i.e., X electrodes). Further, the first terminal of the inductor L1 is connected to the cathode of the diode D5, and the anode of the diode D5 is electrically connected to a low level voltage. The second terminal of the inductor L1 is connected to the cathode of the diode D6, and the anode of the diode D6 is electrically connected to a low level voltage terminal. The first terminal of the inductor L2 is connected to the anode of the diode D7, and the cathode of the D7 is electrically connected to a high level voltage terminal. The second terminal of the inductor L2 is connected to an anode of the diode D8, and the cathode of the diode D8 is electrically connected to a high level voltage terminal.

In FIGS. 8, 9, and 10, the sustain discharge circuits 511 and 511' are connected to the X electrode, and a voltage of 0 V is applied to the Y electrode. However, the sustain discharge circuit is connected to the Y electrode, and the voltage of 0 V may be applied to the X electrode.

As such, according to the exemplary embodiments of the present invention, a transistor that has a lower internal voltage can be used in the sustain discharge circuit. Further, since an element of which an internal voltage is reduced has low resistance, power loss can be reduced, and emission efficiency of the element can be reduced. Further, a manufacturing cost of the sustain discharge circuit can be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device comprising:

a plurality of first electrodes;

a first transistor having a first terminal electrically connected to a first power supply for supplying a first voltage;

a second transistor having a first terminal electrically connected to a second terminal of the first transistor and a second terminal electrically connected to the plurality of first electrodes;

a third transistor having a first terminal electrically connected to the plurality of first electrodes;

a fourth transistor having a first terminal electrically connected to a second terminal of the third transistor and a second terminal electrically connected to a second power supply for supplying a second voltage;

a first capacitor configured to be charged with a third voltage, the first capacitor having a first terminal connected to the first power supply;

a second capacitor configured to be charged with a fourth voltage, the second capacitor having a first terminal connected to a second terminal of the first capacitor and a second terminal electrically connected to the second power supply;

a charge path including a first inductor electrically connected between the plurality of first electrodes and a node corresponding to a contact point between the first capacitor and the second capacitor, the charge path being adapted to increase a voltage of the plurality of first electrodes;

a charge voltage sustaining path electrically connected between the second terminal of the third transistor and the node, the charge voltage sustaining path being adapted to sustain the voltage of the plurality of first electrodes at a fifth voltage;

a discharge path including a second inductor electrically connected between the plurality of first electrodes and the node, the discharge path being adapted to decrease the voltage of the plurality of first electrodes; and a discharge voltage sustaining path electrically connected between the node and the first terminal of the second transistor, the discharge voltage sustaining path being adapted to sustain the voltage of the plurality of first electrodes at a sixth voltage.

2. The plasma display device of claim 1, wherein:

the charge voltage sustaining path comprises a first diode having an anode electrically connected to the second terminal of the third transistor and a cathode electrically connected to the node; and the discharge voltage sustaining path comprises a second diode having an anode electrically connected to the node and a cathode electrically connected to the first terminal of the second transistor.

3. The plasma display device of claim 2, wherein:

the charge voltage sustaining path further comprises a fifth transistor electrically connected between the first terminal of the first inductor and the plurality of first electrodes; and the discharge voltage sustaining path further comprises a sixth transistor electrically connected between the first terminal of the second inductor and the plurality of first electrodes.

4. The plasma display device of claim 3, wherein:

the charge voltage sustaining path further comprises a third diode having an anode electrically connected to the node and a cathode electrically connected to the second terminal of the first inductor; and the discharge voltage sustaining path further comprises a fourth diode having a cathode electrically connected to the node and an anode electrically connected to the second terminal of the second inductor.

5. The plasma display device of claim 2, wherein:

the charge voltage sustaining path further comprises a fifth transistor electrically connected between the first terminal of the first inductor and the node; and the discharge voltage sustaining path further comprises a sixth transistor electrically connected between the first terminal of the second inductor and the node.

6. The plasma display device of claim 5, wherein:

the charge voltage sustaining path further comprises a third diode having an anode electrically connected to the second terminal of the first inductor and a cathode electrically connected to the plurality of first electrodes; and the discharge voltage sustaining path further comprises a fourth diode having an anode electrically connected to the plurality of first electrodes and a cathode electrically connected to the second terminal of the second inductor.

7. The plasma display device of claim 5, further comprising:

a fifth diode having a cathode connected to the first terminal of the first inductor and an anode electrically connected to the second power supply;

a sixth diode having a cathode connected to the second terminal of the first inductor and an anode electrically connected to the second power supply;

a seventh diode having an anode connected to the first terminal of the second inductor and a cathode electrically connected to the first power supply; and an eighth diode having an anode connected to the second terminal of the second inductor and a cathode electrically connected to the first power supply.

8. The plasma display device of any one of claims 3 to 7, further comprising:

a controller adapted to turn on the third and fifth transistors during a first period, to turn on the second, third, and fifth transistors during a second period, to turn on the second and fifth transistors during a third period, to turn on the first and second transistors during a fourth period, to turn on the second and sixth transistors during a fifth period, to turn on the second, third, and sixth transistors during a sixth period, to turn on the third and sixth transistors during a seventh period, and to turn on the third and fourth transistors during an eighth period.

9. The plasma display device of claim 1, wherein the third voltage and the fourth voltage are the same, and correspond to half of the difference between the first voltage and the second voltage.

10. The plasma display device of claim 1, wherein the fifth voltage is the same as the sixth voltage.

11. The plasma display device of any one of claims 1 to 7, where the second voltage is a ground voltage, and the first voltage is a positive voltage.

12. The plasma display device of any one of claims 1 to 7, wherein the first voltage is a ground voltage, and the second voltage is a negative voltage.

13. An apparatus for driving a plasma display device comprising first electrodes and second electrodes, the apparatus comprising:

a plurality of first transistors electrically connected between a first power supply for supplying a first voltage and the first electrodes;

a plurality of second transistors electrically connected between a second power supply for supplying a second voltage and the first electrodes;

a first capacitor adapted to be charged with a third voltage, the first capacitor having a first terminal connected to the first power supply;

a second capacitor adapted to be charged with a fourth voltage, the second capacitor having a first terminal connected to a second terminal of the first capacitor and a second terminal electrically connected to the second power supply;

a first resonance path adapted to increase a voltage of the first electrode using resonance between a first inductor electrically connected between the first electrodes and a node corresponding to a contact point between the first capacitor and the second capacitor, and a panel capacitor formed at the first electrodes;

a first voltage sustaining path comprising a switch adapted to electrically connect a first contact point of contact points among the plurality of second transistors, and the node;

a second resonance path adapted to decrease the voltage of the first electrodes using resonance between the panel capacitor formed at the first electrodes, and a second inductor electrically connected between the first electrodes and the node; and a second voltage sustaining path comprising a switch adapted to electrically connect a second contact point of contact points among the plurality of first transistors and the node.

14. The apparatus of claim 13, wherein:

the first resonance path further comprises a fifth transistor connected between the node and the plurality of first electrodes; and the second resonance path further includes a sixth transistor connected between the plurality of first electrodes and the node.

15. The apparatus of claim 14, wherein in a state where a third transistor is turned on and the fourth voltage is applied to the second terminal of the second capacitor, the voltage of the first electrode is increased through the first resonance path;

in a state where the fourth voltage is applied to the second terminal of the second capacitor, the fourth voltage is applied through the first voltage sustaining path;

in a state where the fourth voltage is applied to the second terminal of the second capacitor, the third transistor is turned off, the second transistor is turned on, and the voltage of the first electrode is increased through the first resonance path;

in a state where the fourth voltage is applied to the second capacitor, the first transistor is turned on, and the first voltage is applied to the first electrodes;

in a state where the fourth voltage is applied to the second terminal of the second capacitor, the first transistor is turned off, the sixth transistor is turned on, and the voltage of the first electrode is decreased through the second resonance path;

in a state where the fourth voltage is applied to the second terminal of the second capacitor, the second transistor is turned off, the third transistor is turned on, and the fourth voltage is applied through the second voltage sustaining path;

in a state where the fourth voltage is applied to the second terminal of the second capacitor, the voltage of the first electrode is decreased through the second resonance path; and in a state where the fourth voltage is applied to the second terminal of the second capacitor, a fourth transistor is turned on, and the second voltage is applied to the first electrode.

16. The apparatus of claim 15, wherein when the first voltage is applied to the first electrodes, a backward current is decreased through the first inductor and a body diode of the fifth transistor; and when the second voltage is applied to the first electrodes, a backward current is decreased through the second inductor and a body diode of the sixth transistor.

* * * * *